US011672356B2

(12) United States Patent
Wornell

(10) Patent No.: US 11,672,356 B2
(45) Date of Patent: Jun. 13, 2023

(54) SEATING CUSHION

(71) Applicant: COMFORT CONCEPTS PTY LIMITED, Bulla (AU)

(72) Inventor: David Wornell, Bulla (AU)

(73) Assignee: COMFORT CONCEPTS PTY LIMITED, Sidney (AU)

( * ) Notice: Subject to any disclaimer, the term of this patent is extended or adjusted under 35 U.S.C. 154(b) by 717 days.

(21) Appl. No.: 16/496,506

(22) PCT Filed: Mar. 26, 2018

(86) PCT No.: PCT/AU2018/000044
§ 371 (c)(1),
(2) Date: Sep. 23, 2019

(87) PCT Pub. No.: WO2018/170534
PCT Pub. Date: Sep. 27, 2018

(65) Prior Publication Data

US 2021/0106144 A1 Apr. 15, 2021

(30) Foreign Application Priority Data

Mar. 24, 2017 (AU) ..... 2017901050

(51) Int. Cl.
*A61G 5/10* (2006.01)
*A47C 27/08* (2006.01)
(Continued)

(52) U.S. Cl.
CPC ..... *A47C 27/084* (2013.01); *A47C 7/142* (2018.08); *A47C 7/18* (2013.01); *A47C 27/088* (2013.01); *A47C 27/10* (2013.01); *A47C 27/18* (2013.01)

(58) Field of Classification Search
CPC . A61G 5/1045; A61G 5/1043; A61G 7/05776
See application file for complete search history.

(56) References Cited

U.S. PATENT DOCUMENTS 4,643,481 A * 2/1987 Saloff ..... A61G 5/1043 297/452.25
5,163,196 A * 11/1992 Graebe ..... A61G 5/1043 5/654

(Continued)

FOREIGN PATENT DOCUMENTS

WO 2000/041598 A1 7/2000

OTHER PUBLICATIONS

International Search Report, dated Jul. 30, 2018 for corresponding PCT patent application No. PCT/AU2018/000044.

*Primary Examiner* — David R Hare
*Assistant Examiner* — Ifeolu A Adeboyejo
(74) *Attorney, Agent, or Firm* — Amster, Rothstein & Ebenstein LLP

(57) ABSTRACT

A pneumatically adjustable bladder system (90) for use in a cushioned seat bottom (24) has one or two rear foam filled bladders (62, 64) for location under the ischial tuberosities of a seated occupant of the seat bottom, and one or more expansion chambers (14, 16) or front foam filled bladders (66, 68) for location under the thighs of the seated occupant. There are air passageways (70, 72, 74, 92) interconnecting the bladders with each other or with an expansion chamber. The system is air tight and the bladders are compressible under the weight of the seated occupant and are expandable when the weight is removed. The compression of a bladder causes air therewith in to be displaced through the air passageways to the expansion chambers or to the other bladders, which then expand. The compression of a bladder under the ischial tuberosities of the seated occupant and the expansion of the expansion chambers or of the other bladders under the thighs of the seated occupant cause the seated occupant to experience a correct level of immersion into the (Continued)

cushioned seat bottom which is desired for effective postural support and prevention of lower back pain.

14 Claims, 20 Drawing Sheets

(51) Int. Cl.

| | |
|---|---|
| ***A47C 7/14*** | (2006.01) |
| ***A47C 7/18*** | (2006.01) |
| ***A47C 27/10*** | (2006.01) |
| ***A47C 27/18*** | (2006.01) |

(56) References Cited

U.S. PATENT DOCUMENTS 5,634,224 A * 6/1997 Gates ..... A47C 27/081 5/654
5,797,155 A * 8/1998 Maier ..... A61G 5/1043 297/284.6
5,839,140 A * 11/1998 Wilkerson ..... A61G 5/1043 5/654
5,893,184 A * 4/1999 Murphy ..... A47C 7/024 297/452.41
6,159,172 A * 12/2000 Gray ..... A61G 5/1043 297/452.41
6,370,716 B1 * 4/2002 Wilkinson ..... A61G 5/1043 297/314
6,413,194 B1 * 7/2002 Gant ..... A47C 7/021 482/112
2006/0091716 A1 5/2006 Fortune et al.
2008/0029940 A1 2/2008 Kammer et al.
2010/0187791 A1 * 7/2010 Izinger ..... A61G 5/1043 280/250.1
2015/0113735 A1 4/2015 Anderson et al.

* cited by examiner

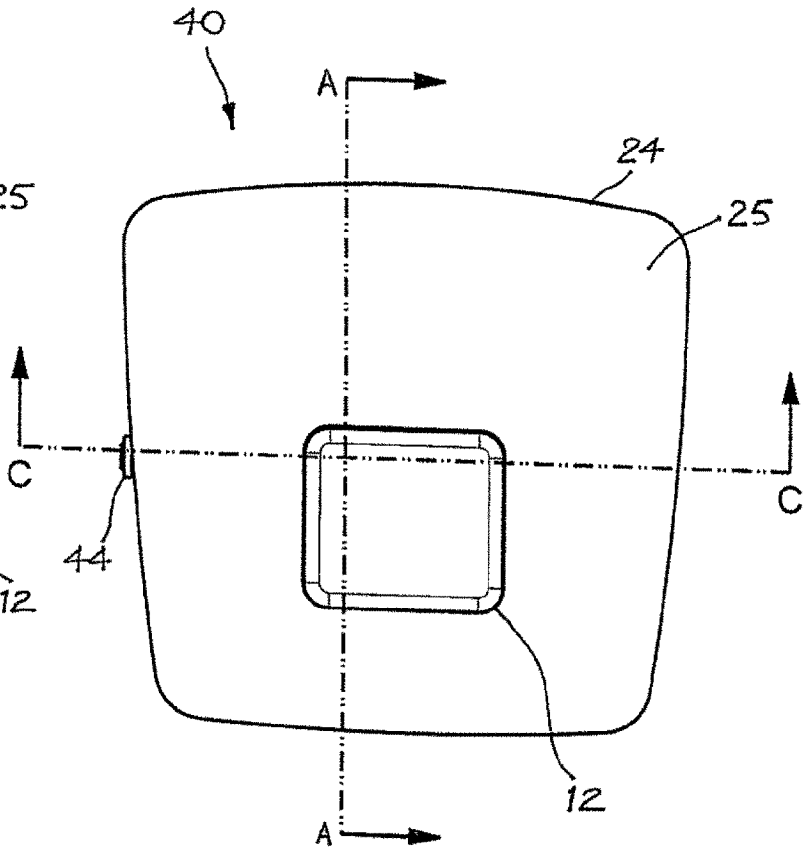
Figure 3
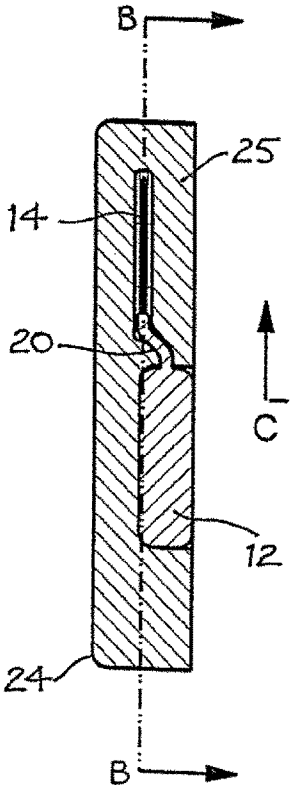
Figure 4 (Section A-A)
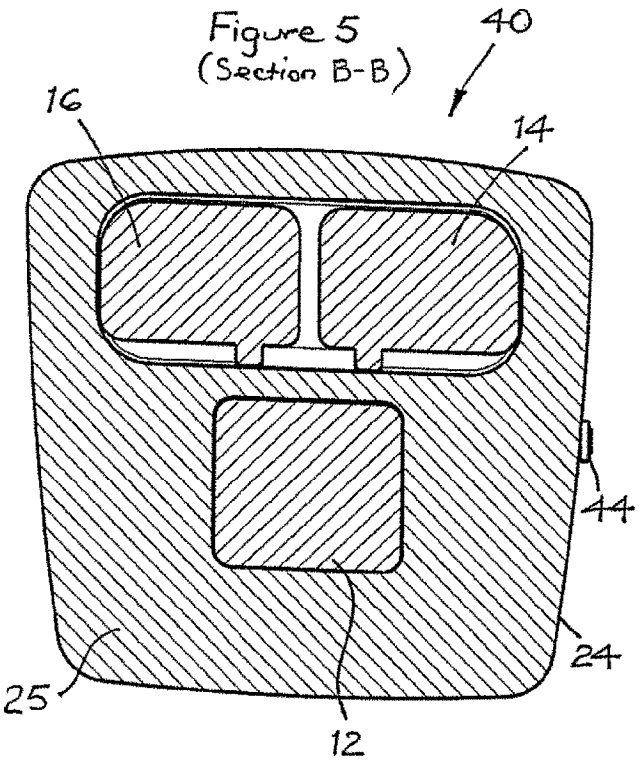
Figure 5 (Section B-B)
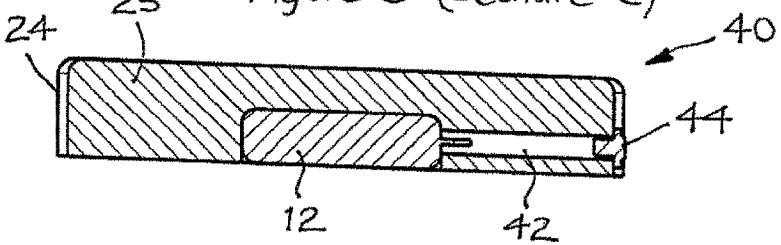
Figure 6 (Section C-C)

(Section A-A)

SEATING CUSHION

CROSS REFERENCE TO RELATED APPLICATIONS

This application is a national phase of PCT application No. PCT/AU2018/000044, filed Mar. 26, 2018, which claims priority to AU patent application No. 2017901050, filed Mar. 24, 2017, all of which are incorporated herein by reference thereto.

TECHNICAL FIELD

The present invention relates to pneumatically adjustable seating cushions and, in particular, to a pneumatically adjustable bladder system for a cushioned seat bottom which can be automatically inflated and deflated as required by the internally controlled displacement of air between a foam filled bladder and one or more expansion chamber, or between a plurality of foam filled bladders. Such an internally controlled displacement of air is produced when a seated occupant of the seat bottom repositions themselves on the seat bottom, and the shifting of their weight automatically adjusts the effective level of postural support of the seated occupant.

BACKGROUND ART

Cushioned seat bottoms that incorporate pneumatically adjustable bladder systems are known, but seldom achieve a correct level of immersion of the occupant into the seat bottom which is desired for effective rotation and stabilization of the pelvis and prevention of lower back pain. This is especially the case for bladder systems which occupy a large horizontal area of the seat bottom.

DISCLOSURE OF INVENTION

It is, therefore, an object of the present invention to provide a pneumatically adjustable bladder system for a cushioned seat bottom of the kind where the horizontal area of the foam filled bladder or bladders of the bladder system is minimized, and the bladder system can still achieve a correct level of immersion of the occupant into the seat bottom which is desired for effective rotation and stabilization of the pelvis and prevention of lower back pain.

According to a first aspect of the present invention, there is provided a pneumatically adjustable bladder system for use in a cushioned seat bottom, the system comprising:

(a) a foam filled bladder adapted to be located under the ischial tuberosities of a seated occupant of the seat bottom, (b) one or more expansion chamber, the or each expansion chamber adapted to be located under the thighs of the seated occupant, and (c) one or more air passageways interconnecting the foam filled bladder with the or a respective expansion chamber, wherein the system is air tight and the foam filled bladder is compressible under the weight of the seated occupant and is expandable when the weight is removed, and wherein the compression of the foam filled bladder causes air from within the foam filled bladder to be displaced through the one or more air passageways to the or each expansion chamber which then expands, whereby the compression of the foam filled bladder under the ischial tuberosities of the seated occupant and the expansion of the or each expansion chamber under the thighs of the seated occupant cause the seated occupant to experience a correct level of immersion into the cushioned seat bottom which is desired for effective postural support and prevention of lower back pain.

In a preferred form of this first aspect of the invention, the bladder system includes an air inlet and outlet passageway from the foam filled bladder to a manually operable external air flow valve.

It is also preferable that the foam filled bladder is compressible and expandable in a vertical direction but not substantially in a horizontal direction.

According to a second aspect of the present invention, there is provided a pneumatically adjustable bladder system for use in a cushioned seat bottom, the system comprising:

(a) at least one rear foam filled bladder adapted to be located under the ischial tuberosities of a seated occupant of the seat bottom, (b) a pair of front foam filled bladders adapted to be located under the thighs of the seated occupant, and (c) a pair of air passageways interconnecting the or each rear foam filled bladder with a respective front foam filled bladder, wherein the system is air tight and the or each rear foam filled bladder is compressible under the weight of the seated occupant and is expandable when the weight is removed, and wherein the compression of the or each rear foam filled bladder causes air from within the or each rear foam filled bladder to be displaced through the air passageways to the front foam filled bladders which then expand, whereby the compression of the or each rear foam filled bladder under the ischial tuberosities of the seated occupant and the expansion of the front foam filled bladders under the thighs of the seated occupant cause the seated occupant to experience a correct level of immersion into the cushioned seat bottom which is desired for effective postural support and prevention of lower back pain.

In a preferred form of the second aspect of the invention, the bladder system includes an air inlet and outlet passageway from a rear foam filled bladder to a manually operable external air flow valve.

It is also preferable that each foam filled bladder is compressible and expandable in a vertical direction but not substantially in a horizontal direction.

According to a third aspect of the present invention, there is provided a pneumatically adjustable seating cushion comprising the aforementioned bladder system and a cushioned seat bottom within which the bladder system is located.

BRIEF DESCRIPTION OF THE DRAWINGS

FIG. 3 is a bottom view of a cushioned seat bottom (with its lower covering surface removed) showing a foam filled bladder and internal foam padding which obscures from view a pair of expansion chambers of a pneumatically adjustable bladder system according to a third embodiment of the invention.

FIG. 4 is a side sectional view through A-A of the seat bottom as shown in FIG. 3 showing sectioned portions of one of the expansion chambers and of the foam filled bladder and an interconnecting air passageway between the chambers and the bladder.

FIG. 5 is a top sectional view through B-B of the seat bottom as shown in FIG. 4 showing sectioned portions of the foam filled bladder and of the expansion chambers which are located in an open cavity molded into the internal foam padding of the seat bottom.

FIG. 6 is a side sectional view through C-C of the seat bottom as shown in FIG. 3 showing sectioned portions of the foam filled bladder and of an air inlet/outlet passageway from the bladder to a manually operable external air flow valve.

MODES FOR CARRYING OUT THE INVENTION

Figure 1:
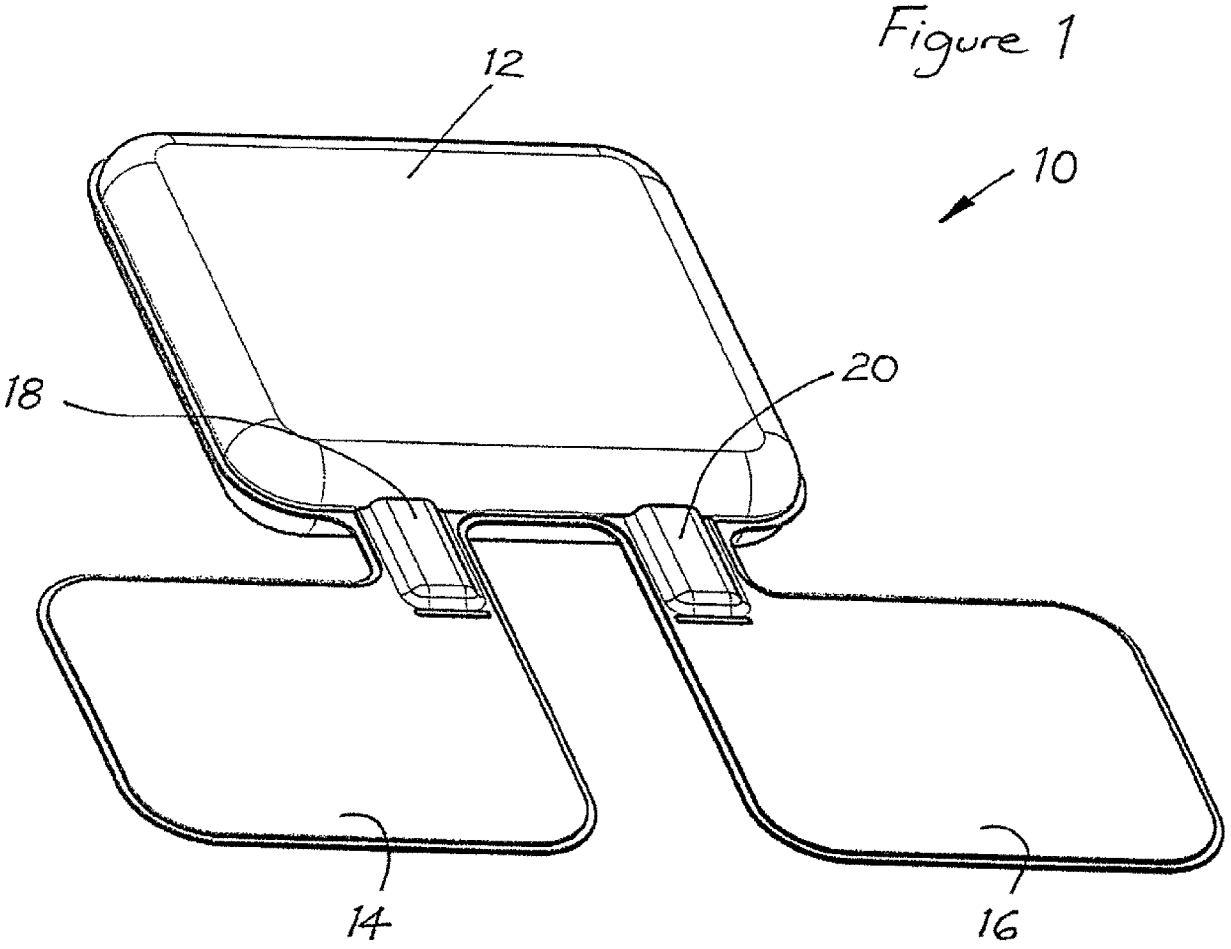
FIG. 1 is a perspective view of a first embodiment of a pneumatically adjustable bladder system of the invention for use in a cushioned seat bottom.

The pneumatically adjustable bladder system 10 shown in FIG. 1 is configured for use in a cushioned seat bottom, and includes an airtight arrangement of a self-inflating bladder 12 (located at the rear end and in the lower region of the seat bottom), a pair of expansion chambers 14, 16 (located at the front end and in the middle region of the seat bottom), and respective air passageways 18, 20 interconnecting the bladder 12 with each of the expansion chambers 14, 16.

The self-inflating bladder 12 has, in this embodiment, an airtight envelope of a flexible and weldable material, such as distortable polyvinyl chloride (PVC) film or, the more preferred, thermoplastic urethane (TPU) film, which is filled with a compressible and expandable foam or foam-like material.

The compressible and expandable material is, in this embodiment, reticulated polyurethane foam, although any suitable form of open cell polyurethane foam may be used.

The foam filled bladder 12 is able to undergo compression and expansion in a vertical direction, but not substantially in a horizontal or sideways direction.

The foam filled bladder 12 is, in this embodiment, formed by using a high frequency welding process to be described in more detail later in the specification.

The air passageways 18, 20 are, in this embodiment, formed by using self-closing, semi-rigid, wrappable braided tubes or sleeves made from polyethylene terephthalate (PET), or may be formed by using semi-rigid internal tubes made from polyvinylchloride (PVC).

Figure 2:
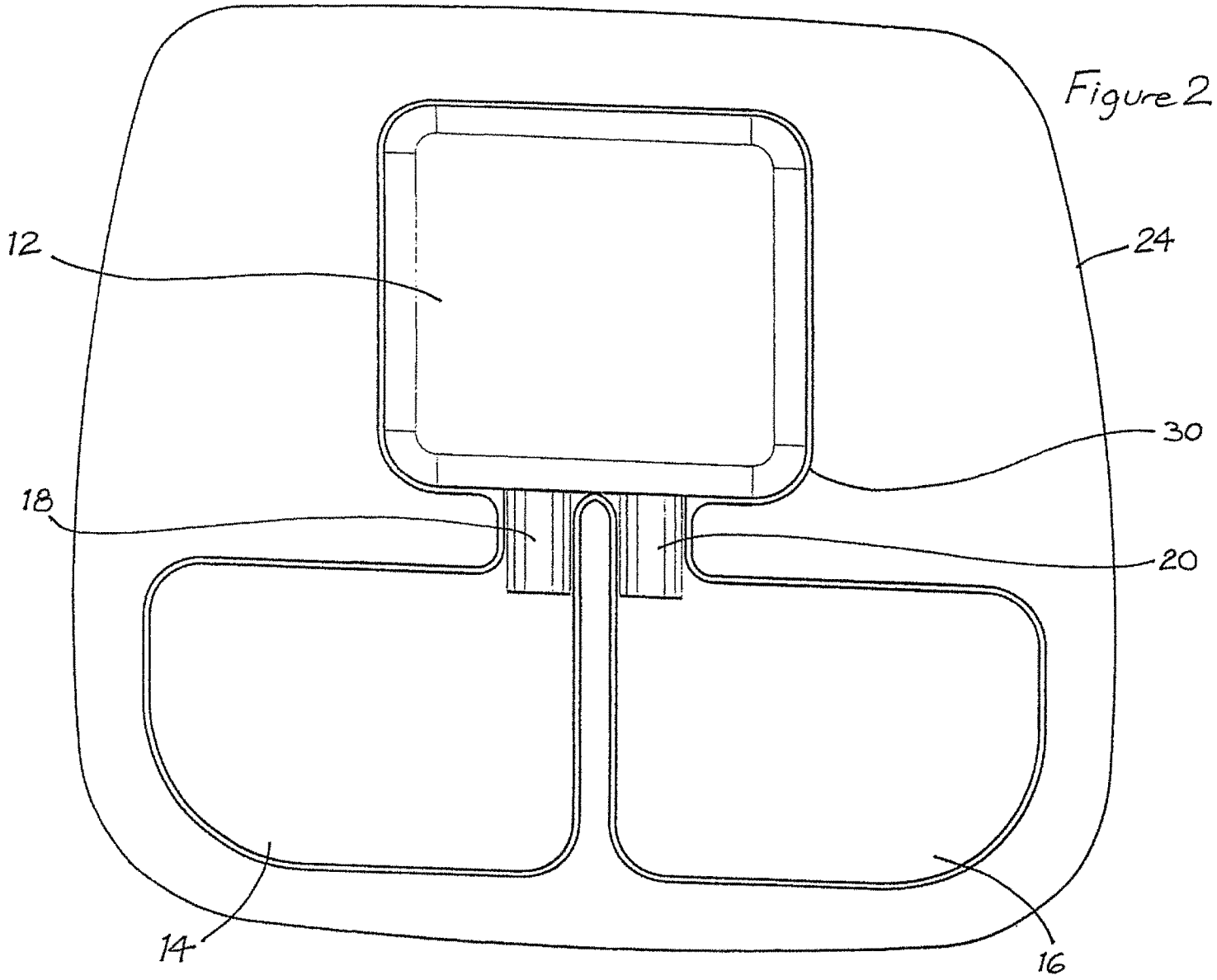
FIG. 2 is a top view of a cushioned seat bottom (with both its upper covering surface and its internal foam padding removed) showing a second embodiment of a pneumatically adjustable bladder system similar to that shown in FIG. 1 located within the seat bottom.
Figure 7:
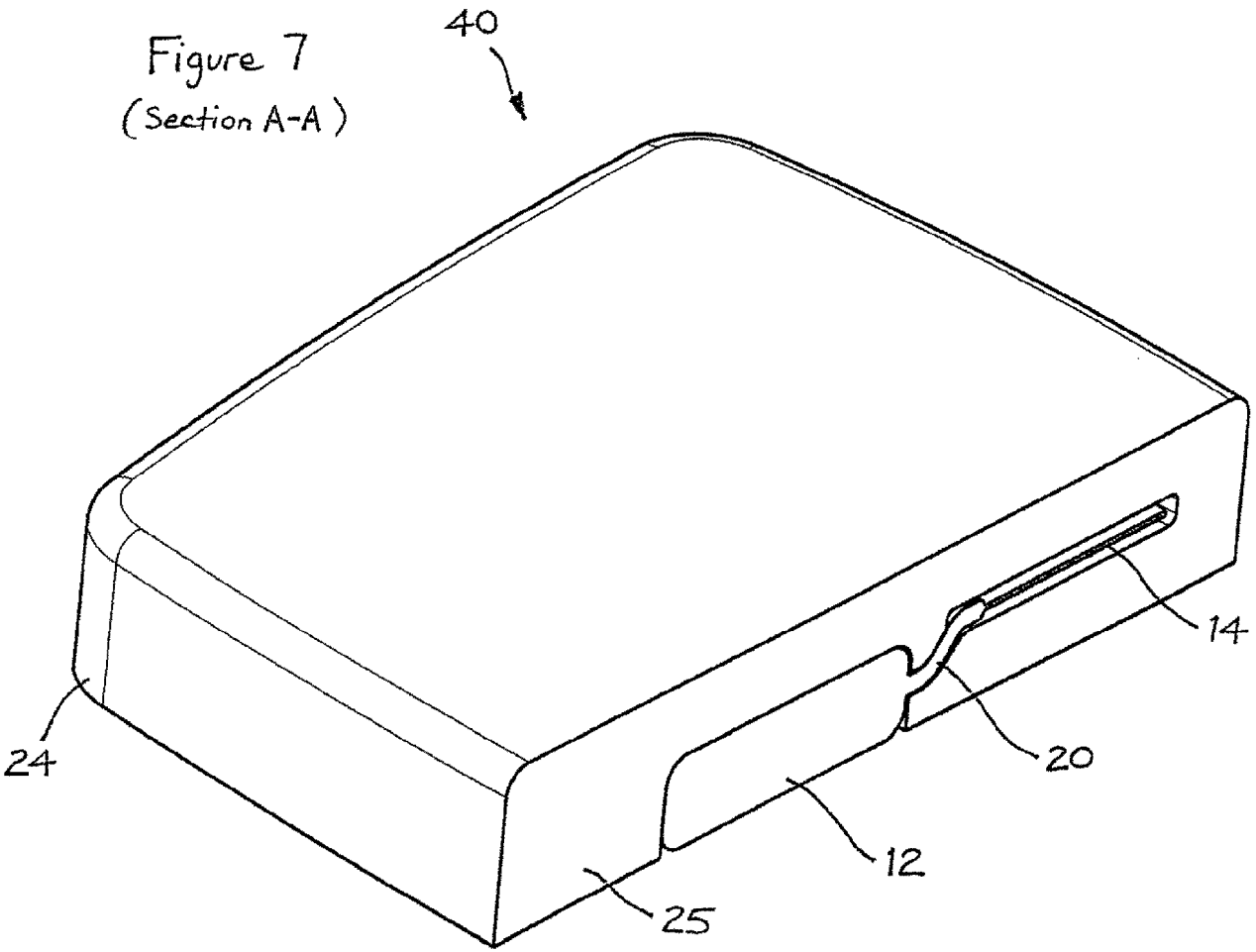
FIG. 7 is a perspective view of the sectioned seat bottom as shown in FIG. 4.

The bladder system 10 is, in use, located within a cushioned seat bottom of a kind similar to a seat bottom 24 shown in FIG. 2 and within which is located a similar bladder system 30. The cushioned seat bottom 24 also contains internal foam padding 25 (not shown in FIG. 2 but shown in FIGS. 3 to 7). For ease of comparison with the bladder system 10, like features of the bladder system 30 shown in FIG. 2 are identified by like numerals.

The bladder system 30 differs from the bladder system 10 by having its expansion chambers 14, 16 (which are still located at the front end and in the middle region of the seat bottom) spaced closer together than are the expansion chambers 14, 16 of the bladder system 10.

When a person sits upon the upper upholstery fabric covering surface of the seat bottom 24, the magnitude and direction of the weight of that person displaces air from the foam filled bladder 12 through the air passageways 18, 20 and to the expansion chambers 14, 16, whereby the bladder 12 is partially compressed by undergoing downward vertical movement, but not any substantial outward horizontal or sideways movement.

The volume of the displaced air is regulated by the size of the expansion chambers 14, 16 and by the amount by which these chambers are permitted to expand (i.e. the volume capacity of the expansion chambers).

The movement of this volume of displaced air from the bladder 12 to the expansion chambers 14, 16 results in a controlled compression of the bladder at the rear end of the seat bottom 24 and a concomitant controlled expansion of the expansion chambers at the front end of the seat bottom, causing the occupant of the seat bottom to automatically experience an advantageous, and hence correct, level of immersion into the seat bottom.

Having a correct level of immersion of the occupant into the seat bottom 24 is desired for effective postural support and the prevention of lower back pain. Such immersion prevents slouching and the resultant C-shaping of the occupant's spine which can place harmful pressure on the lower spine, minimises the seat contact pressure experienced by the occupant's buttock below the ischial tuberosities, provides even pressure distribution, lengthens the spine in a gentle S-shape, and correctly rotates and stabilises the pelvis, all of which would otherwise cause or significantly contribute to lower back pain.

The controlled compression of the foam filled bladder 12, which allows an advantageous, and hence correct, level of immersion of the seated occupant into the seat bottom to be achieved, is largely dependent upon the length (front to rear) and width (side to side) dimensions of the bladder. The present inventor has found that, for any given volume of displaced air, if the length and width of the bladder (at the time of manufacture) are reduced and if the bladder (by its construction) is prevented, in use, from substantially expanding horizontally or sideways, then the extent of the controlled downward vertical movement or compression of the bladder and the extent of the concomitant controlled upward vertical movement or expansion of the expansion chambers will be increased, thus resulting in an increase in the level of immersion of the occupant of the seat into the seat bottom. Optimal immersion can therefore be achieved by an optimal level of reduction, or minimization, in the manufactured length and width dimensions of the bladder, and by enabling the bladder, in use, to undergo compression and expansion in a vertical direction, but not substantially in a horizontal or sideways direction.

By way of example only, if the foam filled bladder (at the time of manufacture) has a width of 30 cm, a length of 25 cm and a height of 5 cm, creating a volume of 3,750 $cm^3$, and if the expansion chambers are designed to have a combined capacity, in use, to receive a volume of 1,000 $cm^3$ of air displaced from the compressed bladder (thus reducing the bladder volume by 1,000 $cm^3$ or about 27%), and given that the width and length of the bladder do not substantially change under compression, then the downward vertical movement of the seated occupant will be about 1.3 cm.

By contrasting example, if the foam filled bladder (at the time of manufacture) has a reduced width of 17 cm, a reduced length of 15 cm, and a maintained height of 5 cm, creating a volume of 1,275 $cm^3$, and if the expansion chambers are designed to have a combined capacity, in use, to receive a volume of 1,000 $cm^3$ of air displaced from the compressed bladder (thus reducing the bladder volume by 1,000 $cm^3$ or about 78%), and given that the width and length of the bladder do not substantially change under compression, then the downward vertical movement of the seated occupant will be about 3.9 cm, resulting in a greater level of immersion of the occupant of the seat into the seat bottom than in the first example above.

The minimum width of the foam filled bladder must accommodate a practical range of widths between the two ischial tuberosities of an occupant of the seat bottom. For example, a narrow range of widths is 10 cm or less, a medium range of widths is between 10 cm and 13 cm, and a wide range of widths is greater than 13 cm. Furthermore, the minimum width of the foam filled bladder should be just sufficient to accommodate the widest width between the ischial tuberosities of a seated occupant. Still further, the minimum length of the foam filled bladder and the distance between the rear edge of the foam filled bladder and the rear edge of the seat bottom (or where the front side of the seat back joins the upper surface of the seat bottom) should be just sufficient to accommodate the practical range of widths between the ischial tuberosities. Still further, the maximum horizontal area of the foam filled bladder should not exceed an area that is just sufficient to accommodate the widest width between the ischial tuberosities.

The location of the expansion chambers 14, 16 in the middle region of the seat bottom 24 (when viewed from any side of the seat bottom 24), such that there is as much internal foam padding 25 above the expansion chambers as there is below the expansion chambers, is advantageous in that, unlike being located in the lower region of the seat bottom, there is less restriction in the upward vertical movement, and thus there is a greater level of expansion, of the expansion chambers.

Furthermore, the location of the expansion chambers 14, 16 at the front end of the seat bottom 24 is advantageous in that most of the weight of the seated occupant is normally directed onto the rear end (or rearward region) of the seat bottom, which means that there is less downward pressure exerted on the expansion chambers, thus allowing them to experience less resistance to their expansion than would be the case if the expansion chambers were located at the rear end of the seat bottom.

As the foam filled bladder 12 is located at the rear end of the seat bottom 24, which is where most of the weight of the seated occupant is normally directed, the bladder will undergo optimal compression, and so the volume of the displaced air from the bladder to the expansion chambers 14, 16 will be optimised to achieve an advantageous level of immersion of the seated occupant into the seat bottom.

The air passageways 18, 20 interconnecting the bladder 12 to the expansion chambers 14, 16 in the seat bottom 24 are constructed and configured so as not to be squeezed to an extent where the displacement of air between the bladder and the expansion chambers is obstructed or impaired. The air passageways 18, 20 extend in a direction which has both a vertical component and a horizontal component of direction or angular inclination (see FIG. 7).

The bladder system 40 shown in FIGS. 3 to 7 is similar to the bladder system 10, and so like features are identified by like numerals, but differs from it by having an air inlet/outlet passageway 42 from the foam filled bladder 12 to a manually operable external air flow valve 44.

The valve 44 can be manually operated to dynamically increase the level of immersion of the seated occupant into the seat bottom 24 beyond the immersion level resulting from the automatic operation of the airtight bladder systems of FIGS. 1 and 2.

Opening of the valve 44, by finger pressure on the valve's button, will allow the seated occupant to displace air from within the bladder system to atmosphere, thus increasing the level of immersion.

When the occupant rises so as to vacate the seat bottom, the bladder will automatically recover displaced air from the expansion chambers, but will only fully re-inflate to its initial volume if the valve 44 is opened (while the seat bottom remains vacated).

Although the air inlet/outlet passageway 42 and the manually operable external air flow valve 44 are, in the bladder system 40 described above, permanent features of the system and so can be used by the seated occupant of the seat bottom 24 whenever manual adjustment of the air pressure within the bladder system is required, these features 42, 44 may alternatively not be permanent, but temporary. As temporary features, the air inlet/outlet passageway 42 and the manually operable external air flow valve 44 may only be present during a period (prior to its use by a seated occupant of the seat bottom, say, during manufacture or installation of the seat bottom) when it is required to set the air pressure within the bladder system 40 to a desired amount for all subsequent users of the seat bottom 24. After setting the air pressure within the bladder system, the air inlet/outlet passageway 42 and the manually operable external air flow valve 44 can then be sealed off from the foam filled bladder 12 to preserve the set air pressure within the bladder system 40. This is followed by the detachment of the air inlet/outlet passageway 42 and the manually operable external air flow valve 44 from the bladder system 40, prior to the use of the seat bottom 24 which incorporates such a bladder system by a seated occupant thereof.

Figure 8:
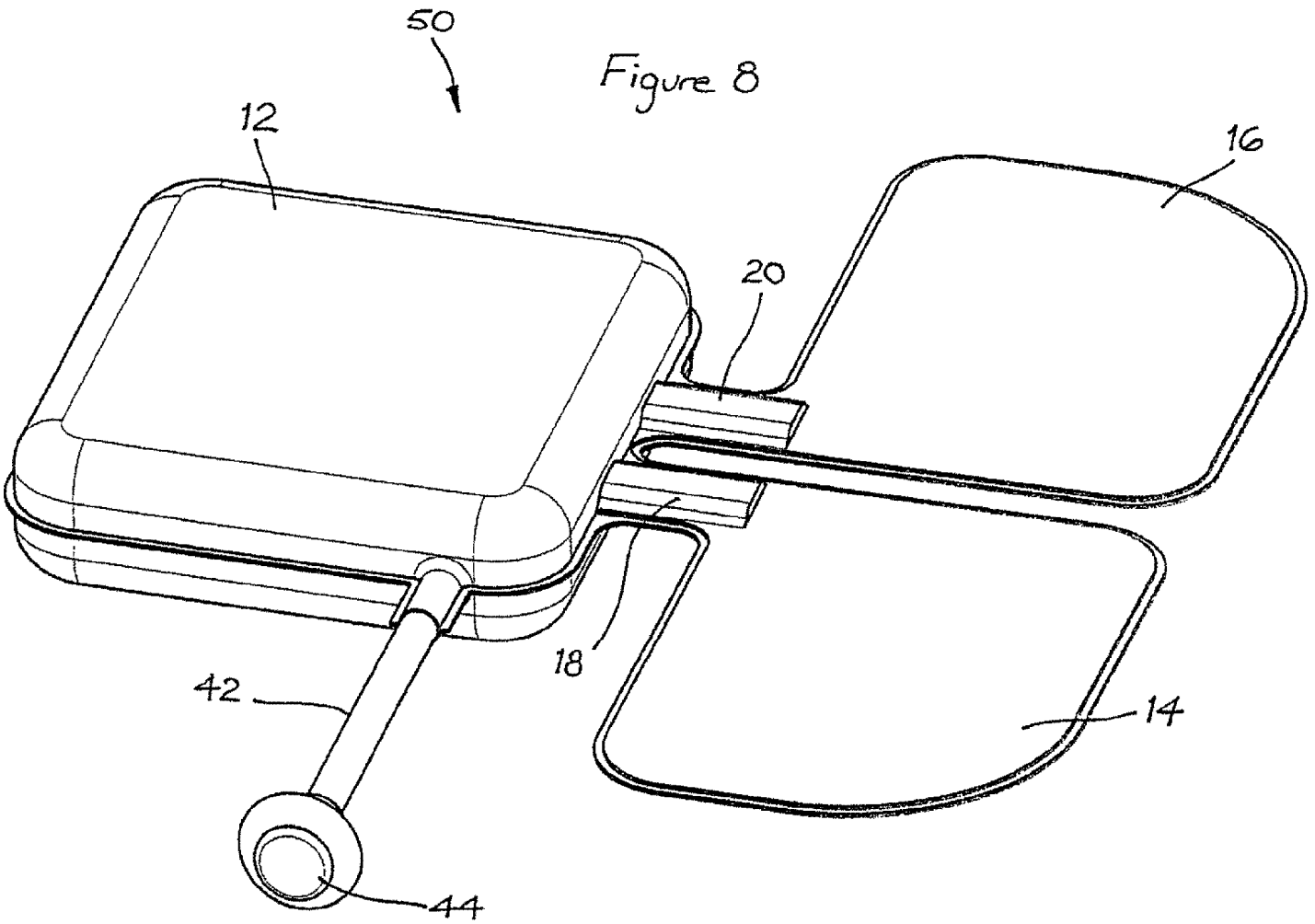
FIG. 8 is a perspective view of a fourth embodiment of a pneumatically adjustable bladder system of the invention for use in a cushioned seat bottom.
Figure 9:
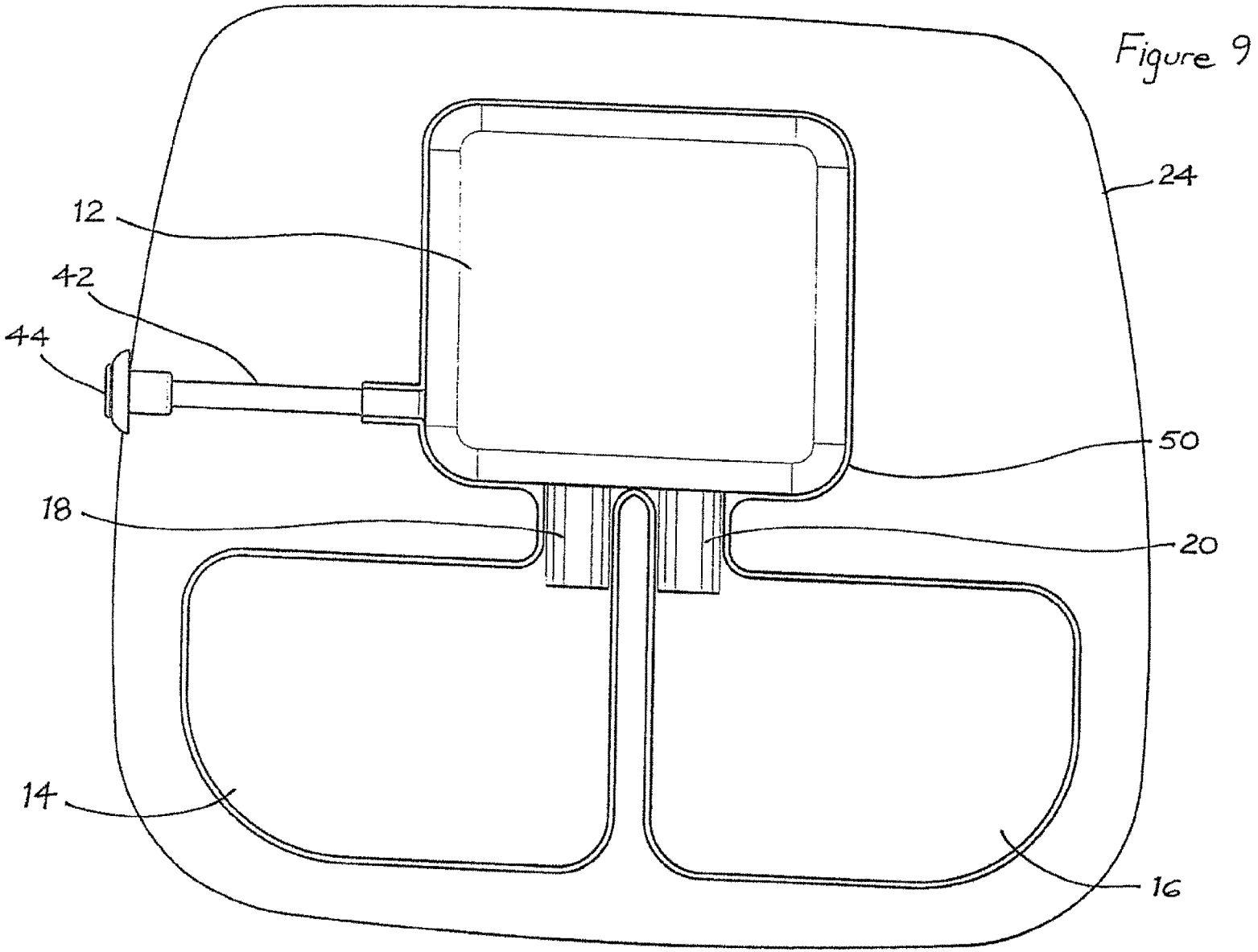
FIG. 9 is a top view of a cushioned seat bottom (with both its upper covering surface and its internal foam padding removed) showing the bladder system of FIG. 8 located within the seat bottom.

The bladder system 50 shown in FIGS. 8 and 9 is similar to the bladder system 40, and so like features are identified by like numerals, but differs from it by having differently proportioned dimensions, and thus differences in relative sizes, between its components and those of the bladder system 40.

For example, as shown in FIG. 9, the larger size of the foam filled bladder 12 is such that it occupies a larger volume of the seat bottom 24 than does the foam filled bladder shown in FIG. 4.

Figure 10:
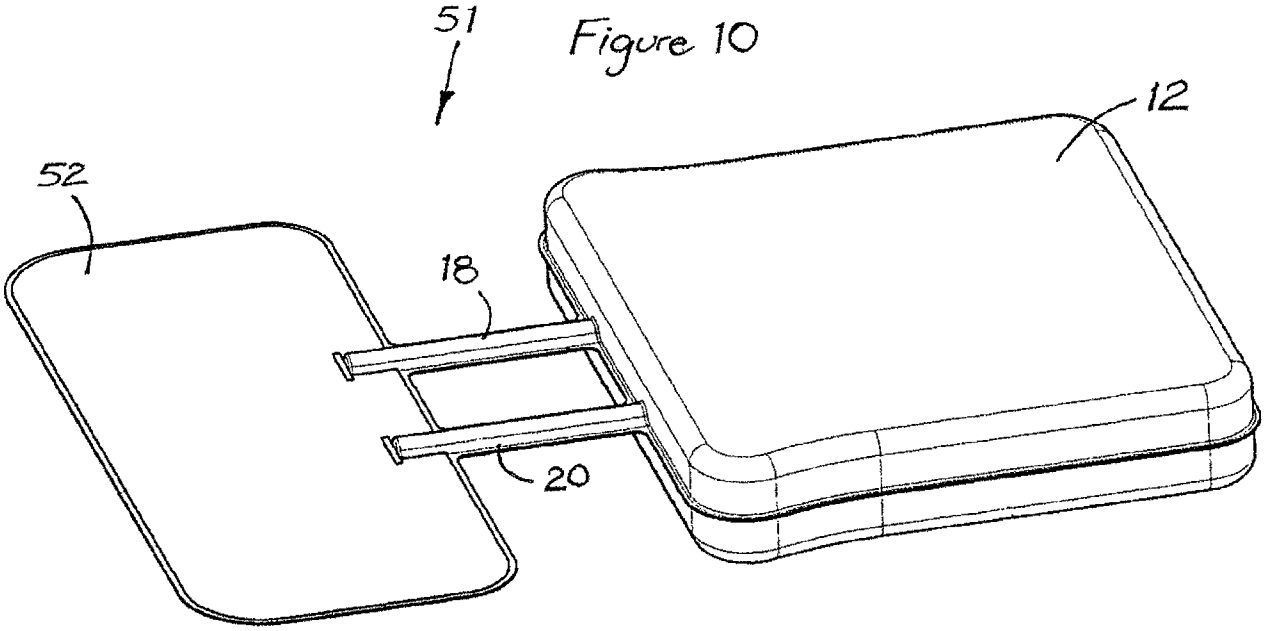
FIG. 10 is a perspective view of a fifth embodiment of a pneumatically adjustable bladder system of the invention for use in a cushioned seat bottom.
Figure 11:
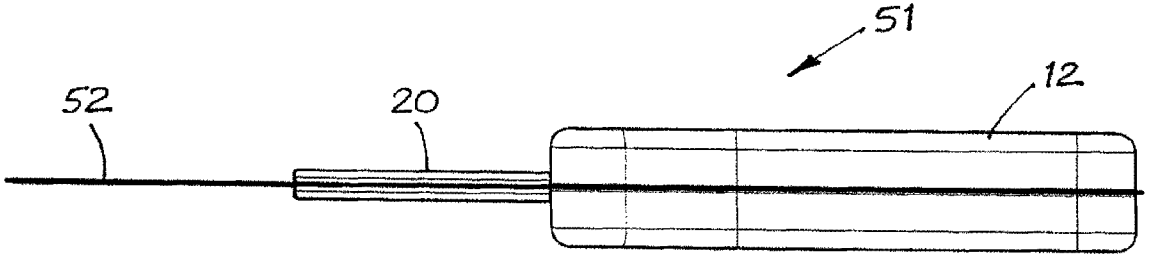
FIG. 11 is a side view of the pneumatically adjustable bladder system as shown in FIG. 10.

In the bladder system 51 shown in FIGS. 10 and 11, a single, sideways elongated, expansion chamber 52 (which is located at the front end and in the middle region of a seat bottom) has replaced the pair of expansion chambers 14, 16 of the bladder systems 10, 30.

The air passageways 18, 20 of the bladder system 51 are, in this embodiment, formed by using self-closing, semi-rigid, wrappable braided tubes or sleeves made from PET, or may be formed by using semi-rigid internal tubes made from PVC. Otherwise, the bladder system 51 is similar to the bladder systems 10, 30, and like features are identified by like numerals.

The expansion chamber 52 is shown uninflated in the side view of FIG. 11, but is inflated by the displacement of air from the foam filled bladder 12 when it undergoes compression under the weight of a seated occupant of the seat bottom.

The expansion chamber 52, when fully inflated, takes the general shape of a cylinder in which it expands in size vertically and contracts in size horizontally to provide a correct level of immersion of the occupant into the seat bottom.

The bladder system 51 may include an air inlet/outlet passageway from the foam filled bladder 12 to a manually operable external air flow valve. When included, the valve can be manually operated to increase the level of immersion of the seated occupant into the seat bottom beyond the immersion level resulting from the automatic operation of the airtight bladder system of FIGS. 10 and 11. The structure, function and operation of such an air inlet/outlet passageway and manually operable external air flow valve, when included in the bladder system of FIGS. 10 and 11, is similar to that which is present in the bladder systems shown in FIGS. 3 to 9.

Figure 12:
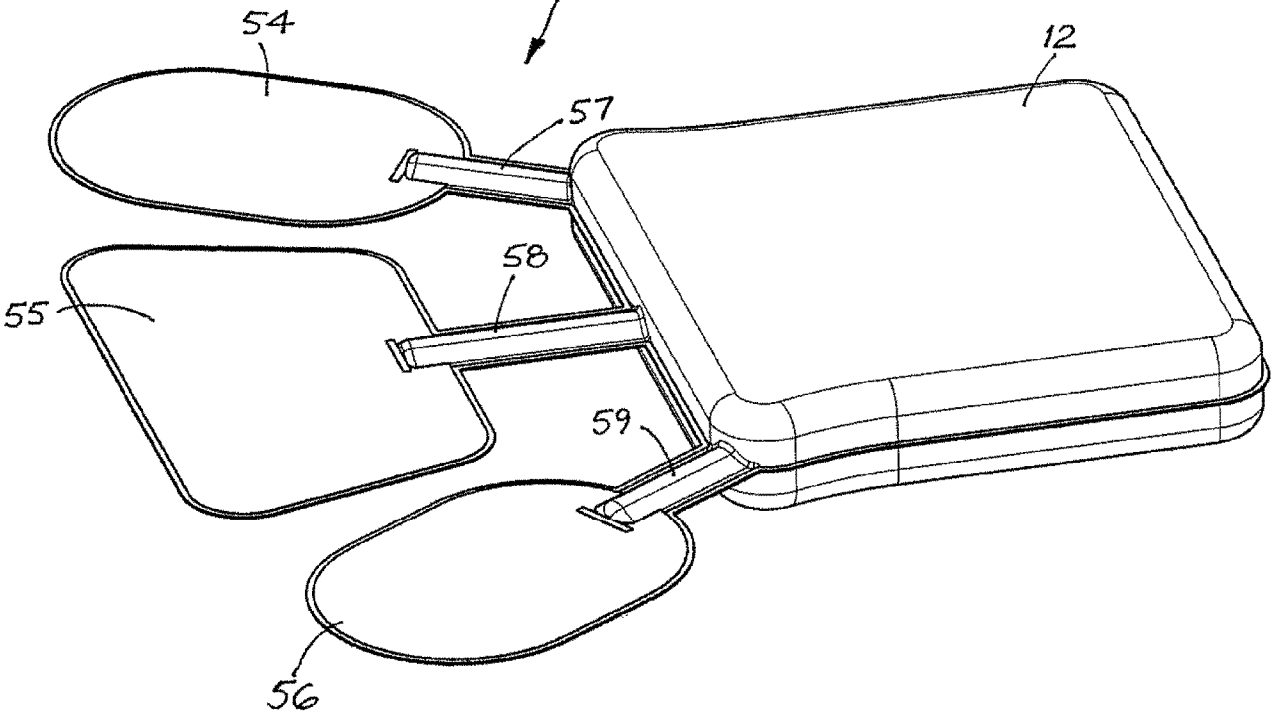
FIG. 12 is a perspective view of a sixth embodiment of a pneumatically adjustable bladder system of the invention for use in a cushioned seat bottom.
Figure 13:
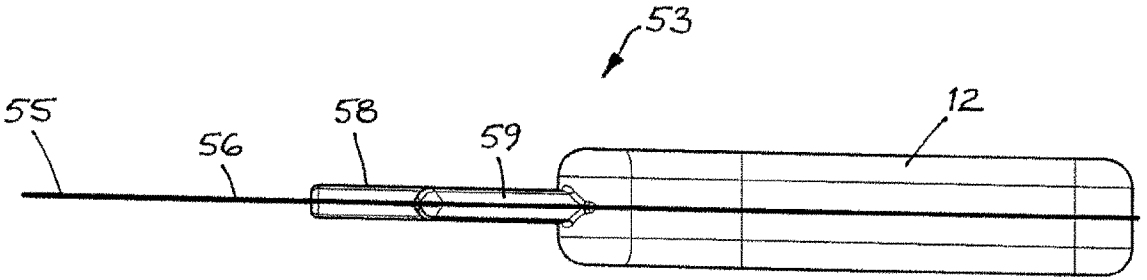
FIG. 13 is a side view of the pneumatically adjustable bladder system as shown in FIG. 12.
Figure 14:
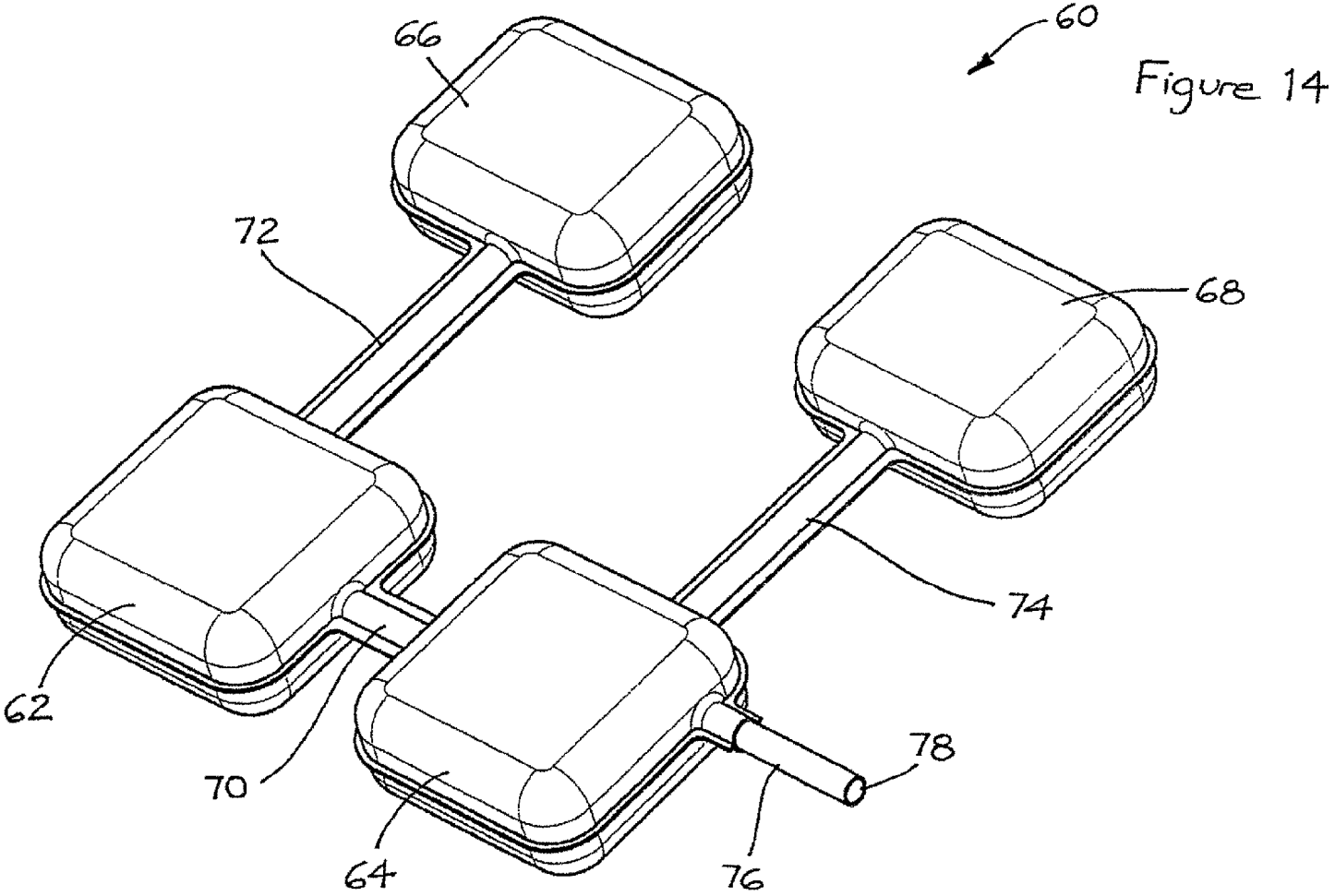
FIG. 14 is a perspective view of a seventh embodiment of a pneumatically adjustable bladder system of the invention for use in a cushioned seat bottom.
Figure 15:
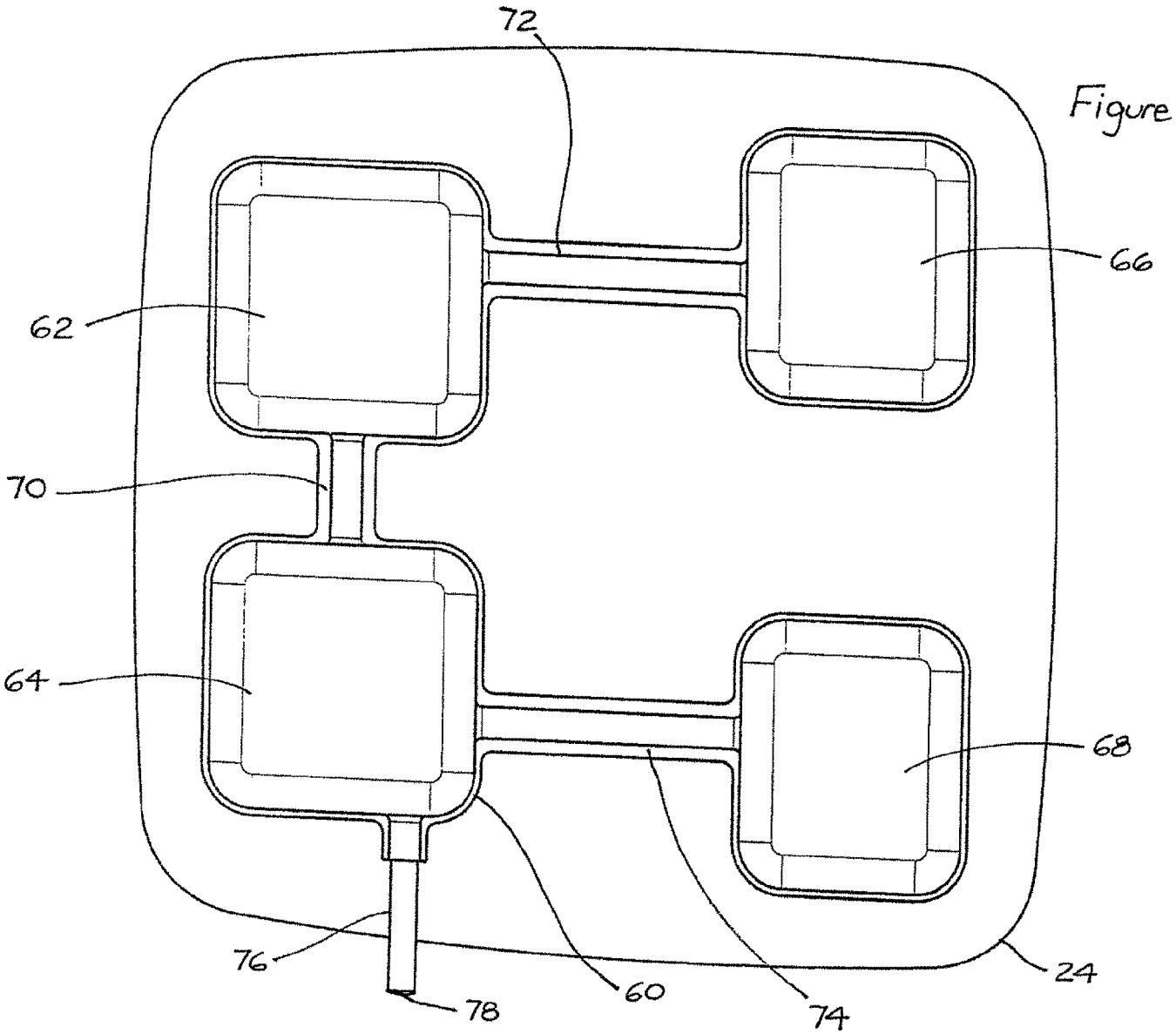
FIG. 15 is a top view of a cushioned seat bottom (with both its upper covering surface and its internal foam padding removed) showing the bladder system of FIG. 14 located within the seat bottom.
Figure 16:
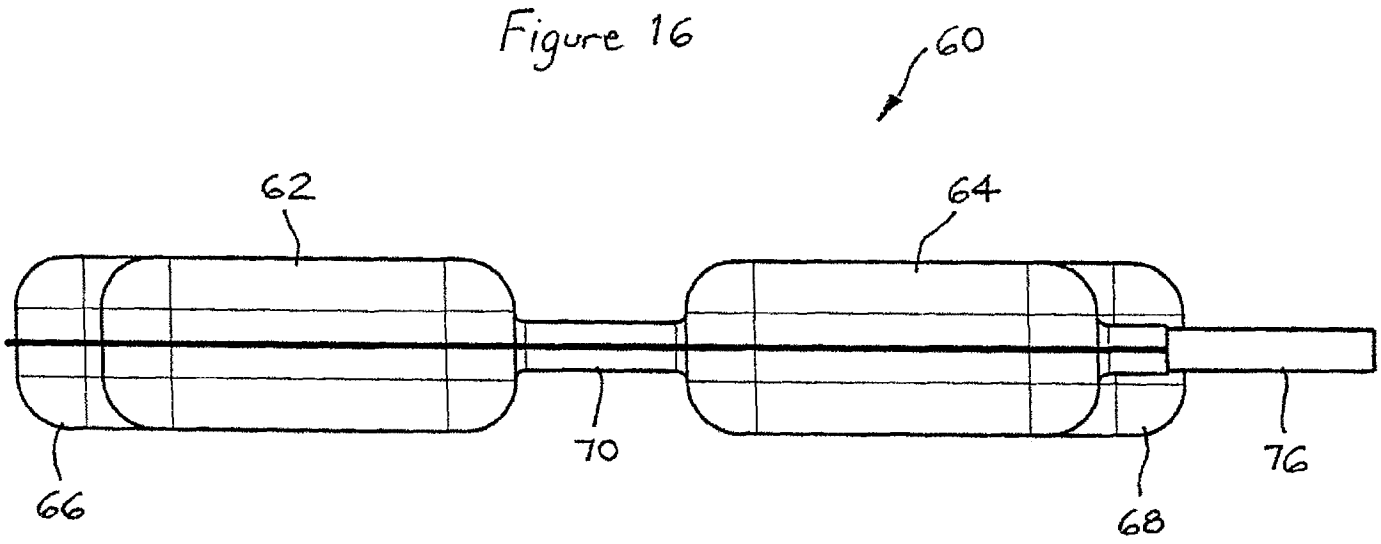
FIG. 16 is a rear end view of the pneumatically adjustable bladder system as shown in FIGS. 14 and 15.
Figure 17:
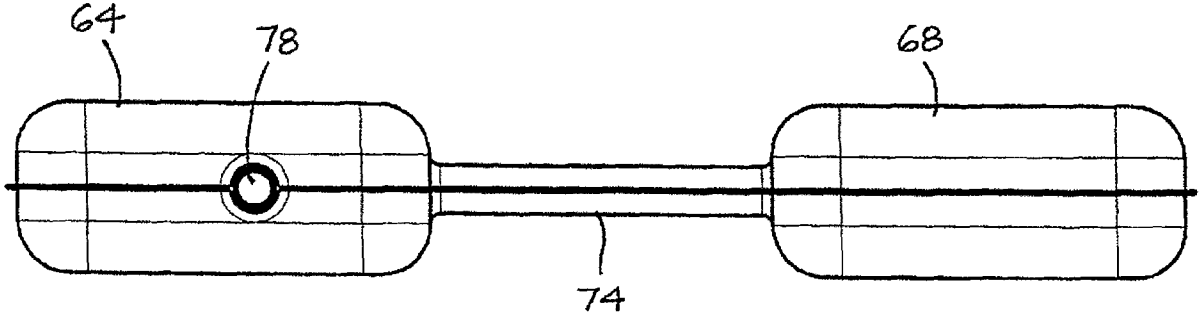
FIG. 17 is a right side view of the pneumatically adjustable bladder system as shown in FIG. 16.

In the bladder system 53 shown in FIGS. 12 and 13, three expansion chambers 54, 55, 56 (which are still located at the front end and in the middle region of a seat bottom) have replaced the single expansion chamber 52 of the bladder system 51 and the pair of expansion chambers 14, 16 of the bladder systems 10, 30. Correspondingly, there are three air passageways 57, 58, 59, each of which interconnect the bladder 12 to a respective expansion chamber 54, 55, 56. Otherwise, the bladder system 53 is similar to the bladder systems 51, 10, 30, and like features are identified by like numerals.

The expansion chambers 54, 55, 56 are shown uninflated in the side view of FIG. 13, but are inflated by the displacement of air from the foam filled bladder 12 when it undergoes compression under the weight of a seated occupant of the seat bottom.

The expansion chambers 54, 55, 56, when fully inflated, take specific shapes which are designed to provide a correct level of immersion of the occupant into the seat bottom.

The bladder system 53 may include an air inlet/outlet passageway from the foam filled bladder 12 to a manually operable external air flow valve. When included, the valve can be manually operated to increase the level of immersion of the seated occupant into the seat bottom beyond the immersion level resulting from the automatic operation of the airtight bladder system of FIGS. 12 and 13. The structure, function and operation of such an air inlet/outlet passageway and manually operable external air flow valve, when included in the bladder system of FIGS. 12 and 13, is similar to that which is present in the bladder systems shown in FIGS. 3 to 9.

As with the bladder systems 10, 30, 40, 50, 51, 53, a correct level of immersion of the occupant into the seat bottom which is desired for effective postural support and the prevention of lower back pain, can also be achieved by the bladder system 60 shown in FIGS. 14 to 17. Moreover, the bladder system 60 can achieve the correct level of immersion dynamically or automatically with any weight shifting movement of the seated occupant.

In the bladder system 60, there are no expansion chambers, as these have been replaced by foam filled bladders. All such foam filled bladders have similar properties to those used in the bladder systems 10, 30, 40, 50, 51, 53.

The bladder system 60 includes four foam filled bladders 62, 64, 66, 68. Two rear bladders 62, 64 are interconnected by an air passageway 70, a left front foam filled bladder 66 is connected to the left rear foam filled bladder 62 by an air passageway 72, and a right front foam filled bladder 68 is connected to the right rear foam filled bladder 64 by an air passageway 74.

There is an air inlet/outlet passageway 76 from the right rear foam filled bladder 64 to a manually operable external air flow valve 78. In alternative embodiments, the air inlet/outlet passageway is connected to any one of the other bladders 62, 66, 68. The operation of the valve 78 is similar to the operation of the valve 44 of the bladder systems 40, 50 shown in FIGS. 3 to 7 and FIGS. 8 and 9, respectively. In an alternative embodiment of bladder system 60, the air inlet/outlet passageway 76 and the manually operable external air flow valve 78 may be omitted, such as when they are only temporary features, say, during the manufacture or installation of the seat bottom 24 as described earlier.

The left and right rear bladders 62, 64 are located within respective molded cavities formed in the internal foam padding 25 at the upper region of the seat bottom (when viewed from any side of the seat bottom), and are positioned so that, in use, they are each directly underneath a respective ischial tuberosity of a seated occupant. The left and right front bladders 66, 68 are similarly located within respective molded cavities, but are positioned so that, in use, they are each directly underneath a respective thigh of the seated occupant.

Figure 18:
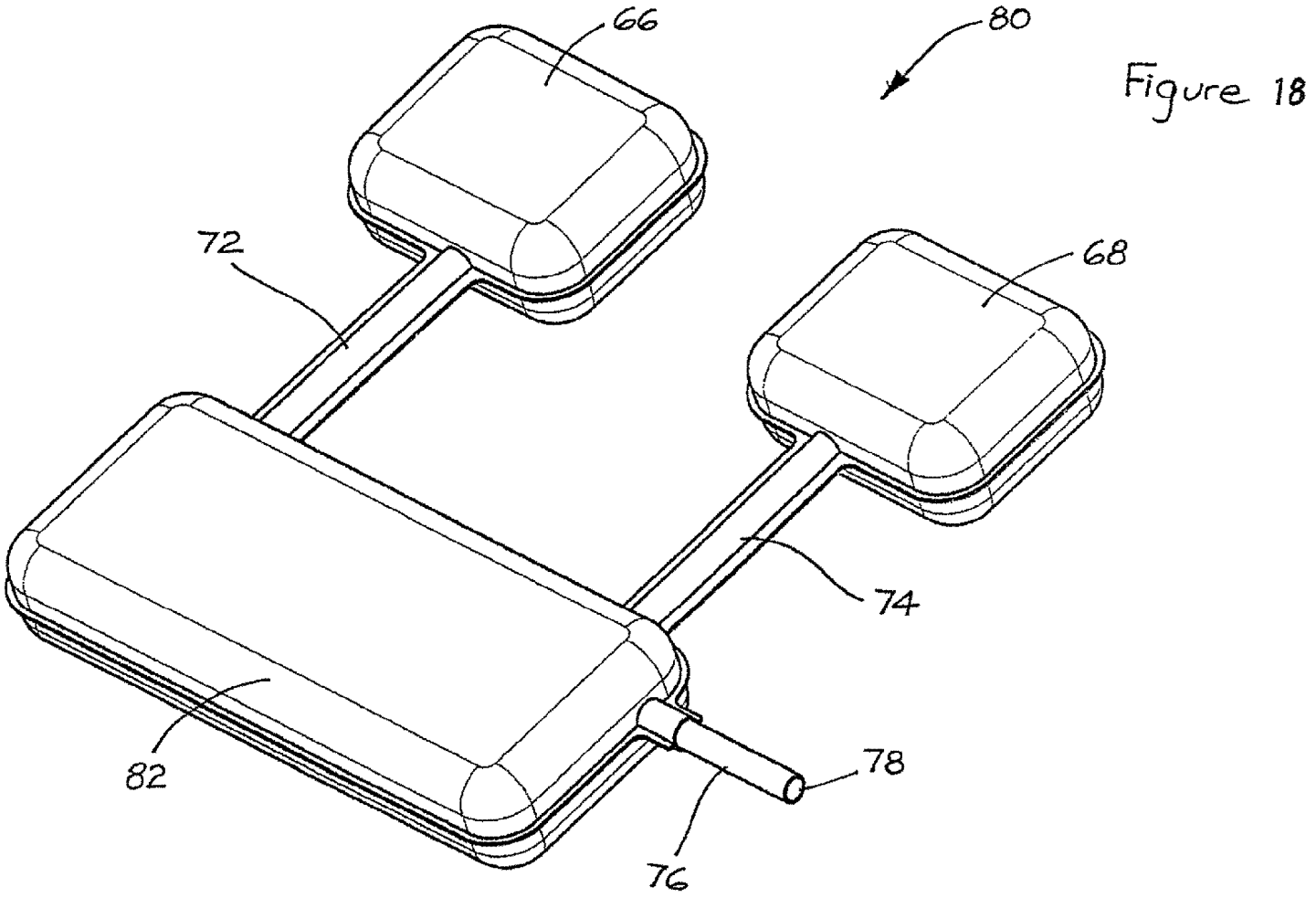
FIG. 18 is a perspective view of an eighth embodiment of a pneumatically adjustable bladder system of the invention for use in a cushioned seat bottom.
Figure 19:
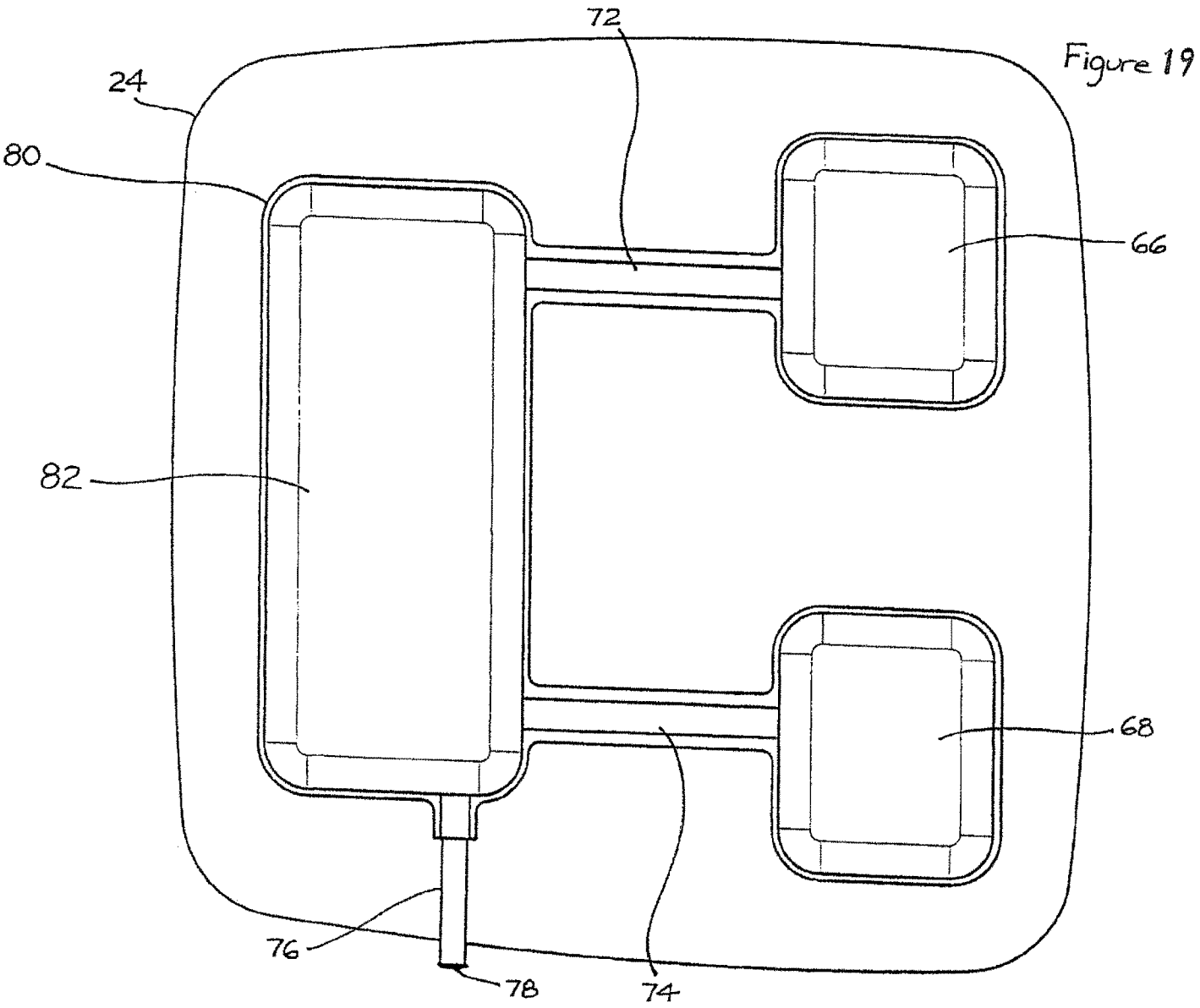
FIG. 19 is a top view of a cushioned seat bottom (with both its upper covering surface and its internal foam padding removed) showing the bladder system of FIG. 16 located within the seat bottom.

The desired or dynamic automatic adjustment of the effective postural support to achieve the correct level of immersion and the prevention of lower back pain in response to any weight shifting movement of the seated occupant, can also be achieved by the bladder system 80 shown in FIGS. 18 and 19.

In the bladder system 80, a single, sideways elongated, rear foam filled bladder 82 has replaced the left and right rear foam filled bladders 62, 64 of the bladder system 60. Otherwise, the bladder system 80 is similar to the bladder system 60, and like features are identified by like numerals.

The bladder 82 is positioned so that, in use, it is directly underneath both of the two ischial tuberosities of a seated occupant.

There is an air inlet/outlet passageway 76 from the rear foam filled bladder 82 to a manually operable external air flow valve 78. In alternative embodiments, the air inlet/outlet passageway is connected to any one of the other bladders 66, 68. The operation of the valve 78 is similar to the operation of the valve 44 of the bladder systems 40, 50 shown in FIGS. 3 to 7 and FIGS. 8 and 9, respectively. In an alternative embodiment of bladder system 80, the air inlet/outlet passageway 76 and the manually operable external air flow valve 78 may be omitted, such as when they are only temporary features, say, during the manufacture or installation of the seat bottom 24 as described earlier.

Figure 20:
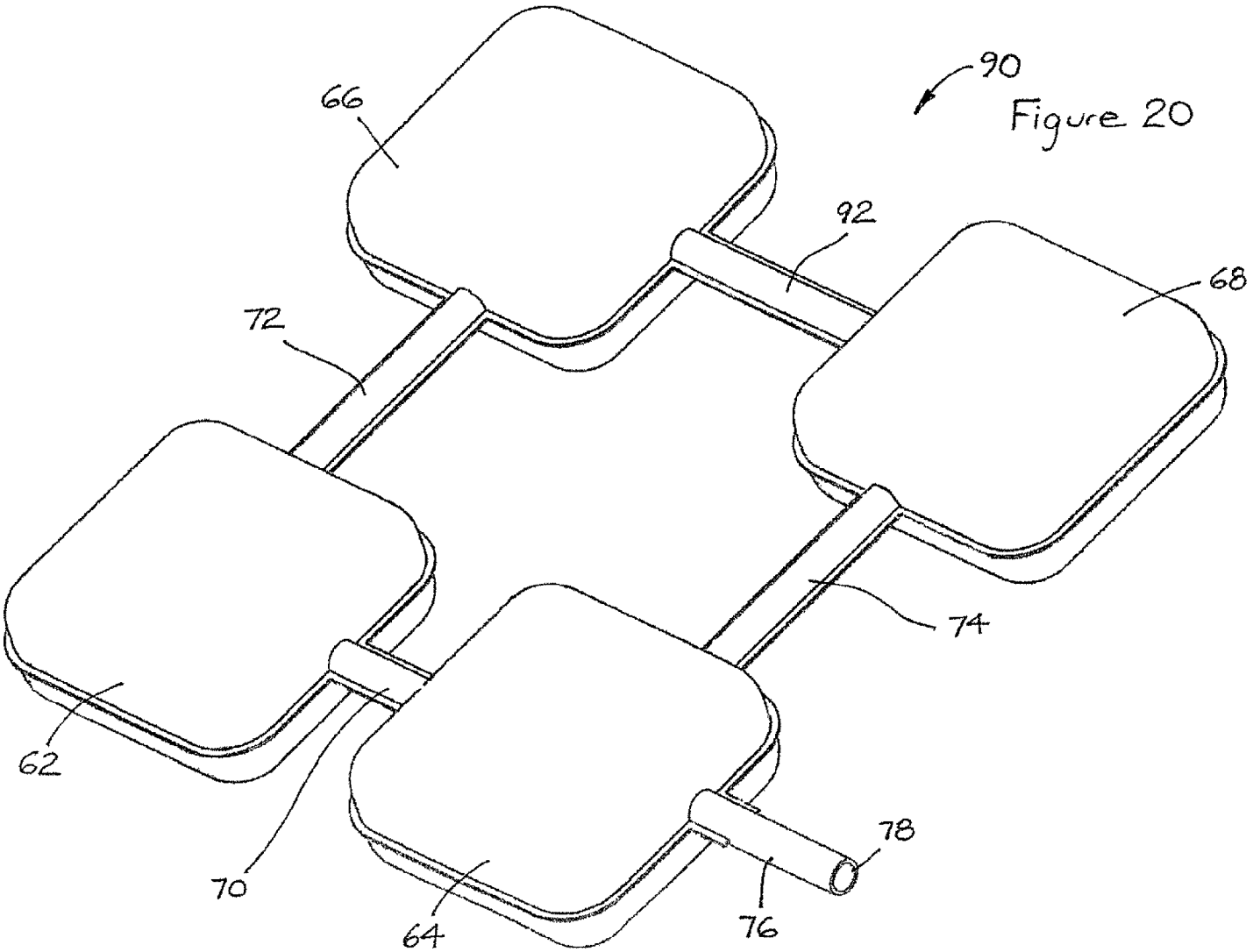
FIG. 20 is a perspective view of a ninth embodiment of a pneumatically adjustable bladder system of the invention for use in a cushioned seat bottom.
Figure 21:
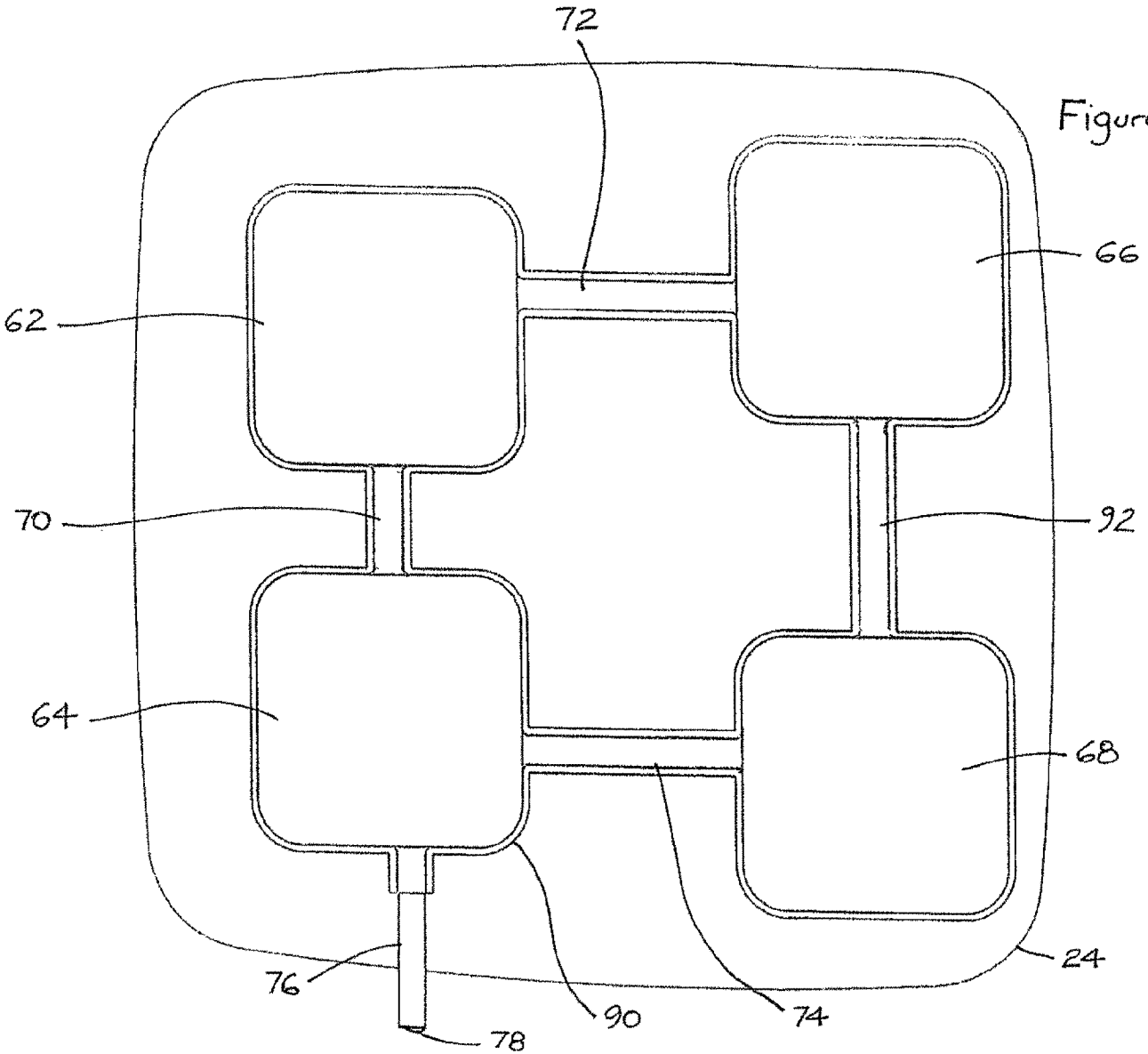
FIG. 21 is a top view of a cushioned seat bottom (with both its upper covering surface and its internal foam padding removed) showing the bladder system of FIG. 20 located within the seat bottom.

The desired dynamic or automatic adjustment of the effective postural support to achieve the correct level of immersion and the prevention of lower back pain in response to any weight shifting movement of the seated occupant, can also be achieved by the bladder system 90 shown in FIGS. 20 and 21, which is similar to the bladder system 60, and like features are identified by like numerals.

In the bladder system 90, like the bladder system 60, there are four foam filled bladders 62, 64, 66, 68, and the two rear bladders 62, 64 are interconnected by an air passageway 70, a left front foam filled bladder 66 is connected to the left rear foam filled bladder 62 by an air passageway 72, and a right front foam filled bladder 68 is connected to the right rear foam filled bladder 64 by an air passageway 74. However, the two front bladders 66, 68 are also interconnected by an air passageway 92.

There is an air inlet/outlet passageway 76 from the right rear foam filled bladder 64 to a manually operable external air flow valve 78. In alternative embodiments, the air inlet/outlet passageway is connected to any one of the other bladders 62, 66, 68. The operation of the valve 78 is similar to the operation of the valve 44 of the bladder systems 40, 50 shown in FIGS. 3 to 7 and FIGS. 8 and 9, respectively. In an alternative embodiment of bladder system 90, the air inlet/outlet passageway 76 and the manually operable external air flow valve 78 may be omitted, such as when they are temporary features, say, during the manufacture or installation of the seat bottom 24, as described earlier.

The left and right rear bladders 62, 64 are located within respective molded cavities formed in the internal foam padding 25 at the upper region of the seat bottom (when viewed from any side of the seat bottom), and are positioned so that, in use, they are each directly underneath a respective ischial tuberosity of a seated occupant. The left and right front bladders 66, 68 are similarly located within respective molded cavities, but are positioned so that, in use, they are each directly underneath a respective thigh of the seated occupant.

The bladder systems 60, 80, 90 are initially in a partially compressed/partially inflated state whereby any one of their foam filled bladders is ready to receive a limited volume of air displaced from an interconnected foam filled bladder of the system.

When a seat bottom is then occupied by a person and the ischial tuberosities of the seated occupant are located directly above the left and right rear foam filled bladders 62, 64 of the bladder system 60 or the bladder system 90 or above the single, sideways elongated, rear foam filled bladder 82 of the bladder system 80, the weight of the occupant will compress the already partially compressed rear bladders 62, 64 or 82, respectively, so as to displace a limited volume of air into the partially inflated left and right front foam filled bladders 66, 68, directly above which the thighs of the seated occupant are supported.

The filling of the front bladders 66, 68 with displaced air from the rear bladders 62, 64 or 82 in this way, as well as, by a reversal of the direction of the air displacement, the filling of the rear bladders 62, 64 or 82, is provided dynamically or automatically with any weight shifting movement of the seated occupant.

In the bladder system 90, air can additionally be displaced from one front foam filled bladder to the other front foam filled bladder, resulting in even more rapid automatic adjustment of the effective postural support to achieve the correct level of immersion and the prevention of lower back pain in response to any weight shifting movement of the seated occupant.

The controlled compression of the foam filled bladders, which allows an advantageous, and hence correct, level of immersion of the seated occupant into the seat bottom to be achieved, is largely dependent upon the length (front to rear) and width (side to side) dimensions of the bladders in the bladder systems 60, 80, 90. The present inventor has found that, for any given volume of displaced air, if the length and width of the bladders (at the time of manufacture) are reduced and if the bladders (by their construction) are prevented, in use, from substantially expanding horizontally or sideways, then the extent of the controlled downward vertical movement or compression of the rear bladders and the extent of concomitant controlled upward vertical movement or expansion of the front bladders will be increased, thus resulting in an increase in the level of immersion of the occupant of the seat into the seat bottom. Optimal immersion can therefore be achieved by an optimal level of reduction, or minimization, in the manufactured length and width dimensions of the bladders of the bladder systems 60, 80, 90, and by enabling the bladders, in use, to undergo compression and expansion in a vertical direction, but not substantially in a horizontal or sideways direction.

Figure 22:
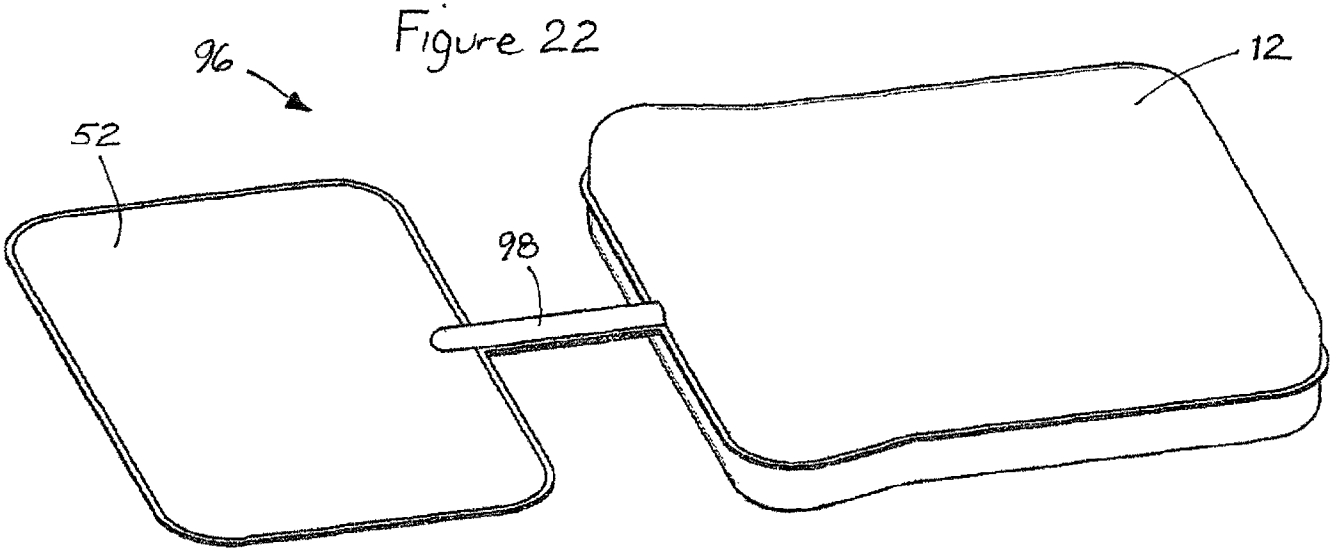
FIG. 22 is a perspective view of a tenth embodiment of a pneumatically adjustable bladder system of the invention for use in a cushioned seat bottom.
Figure 23:
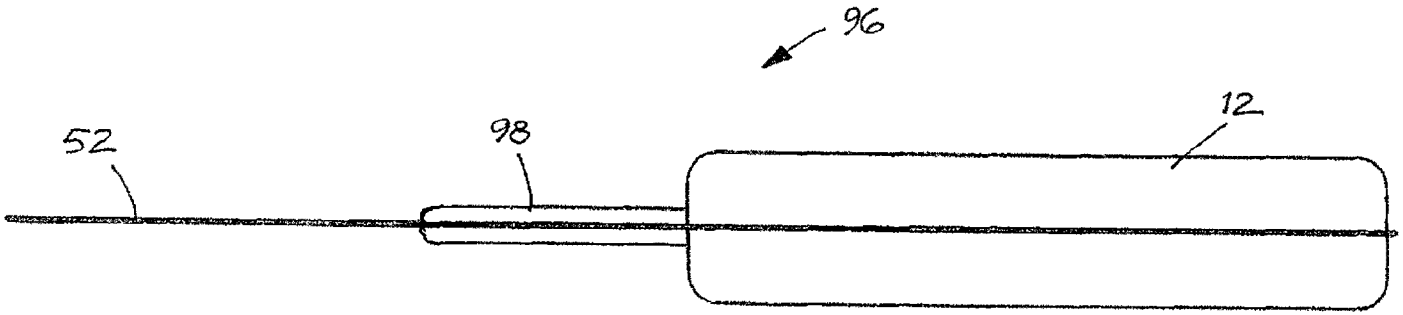
FIG. 23 is a side view of the pneumatically adjustable bladder system as shown in FIG. 22.

The bladder system 96 shown in FIGS. 22 and 23 is similar to the bladder system 51, and so like features are identified by like numerals, but differs from it by having a single air passageway 98 interconnecting the bladder 12 with the expansion chamber 52 instead of a pair of air passageways 18, 20 and by having differently proportioned dimensions, particularly of the expansion chamber 52 which extends further towards the front end of the seat bottom.

The air passageway 98, like each of the air passageways 18, 20, is, in this embodiment, formed by using self-closing, semi-rigid, wrappable braided tubes or sleeves made from PET, or may be formed by using semi-rigid internal tubes made from PVC.

The bladder system 96 may include an inlet/outlet passageway from the foam filled bladder 12 to a manually operable external air flow valve. When included, the valve can be manually operated to increase the level of immersion of the seated occupant into the seat bottom beyond the immersion level resulting from the automatic operation of the airtight bladder system of FIGS. 22 and 23. The structure, function and operation of such an air inlet/outlet passageway and manually operable external air flow valve, when included in the bladder system of FIGS. 22 and 23, is similar to that which is present in the bladder systems shown in FIGS. 3 to 9.

Figure 24:
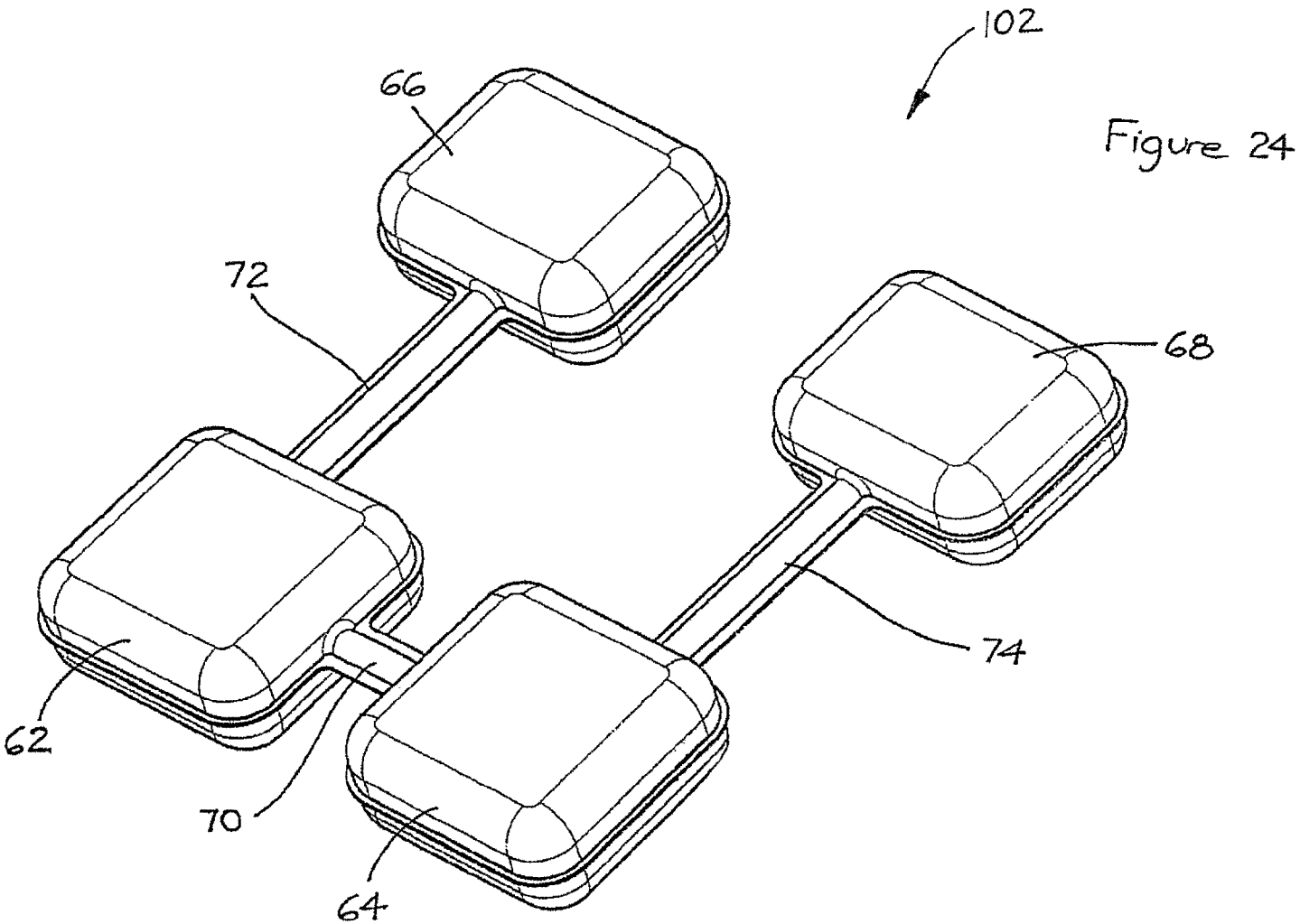
FIG. 24 is a perspective view of an eleventh embodiment of a pneumatically adjustable bladder system of the invention for use in a cushioned seat bottom.
Figure 25:
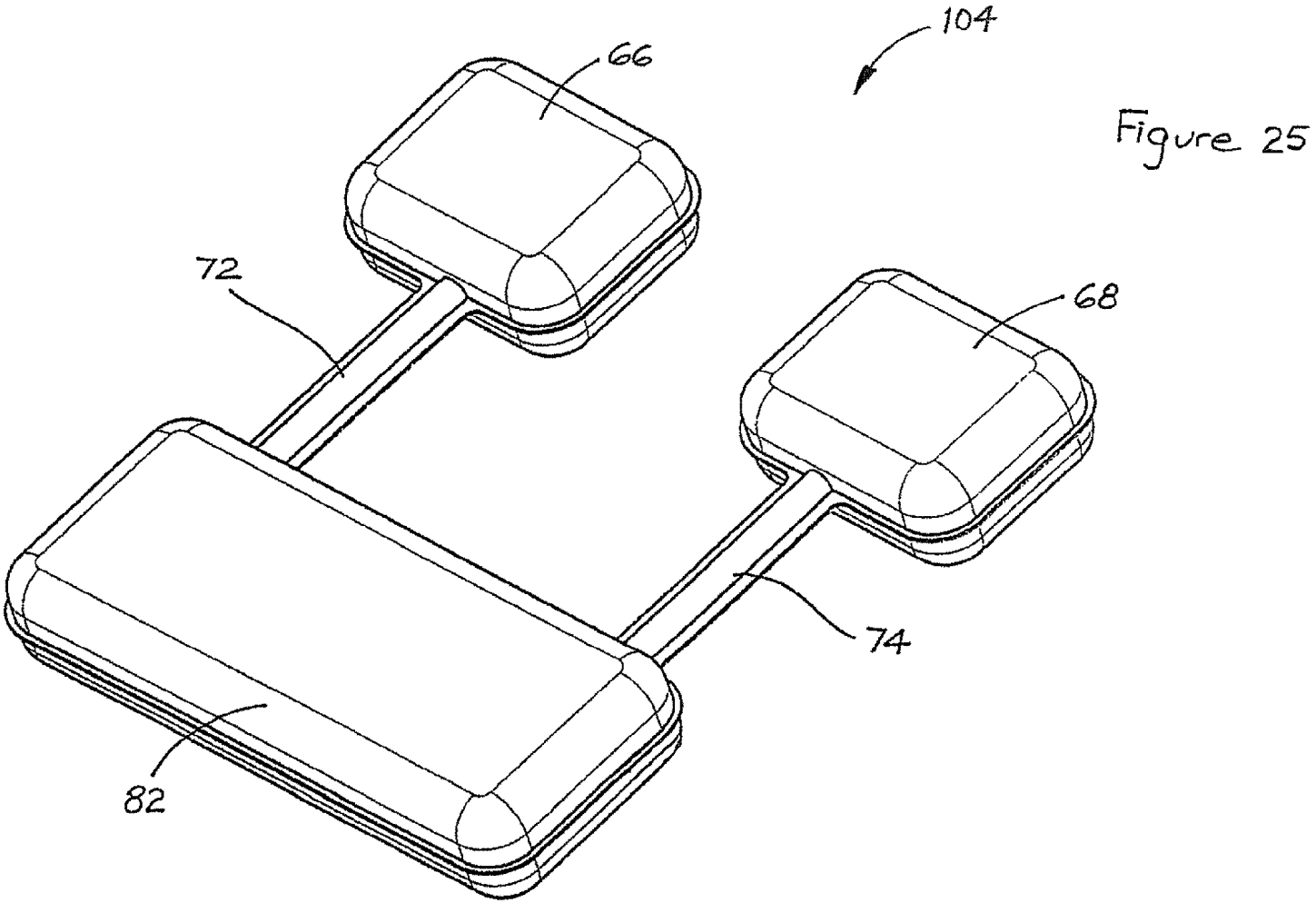
FIG. 25 is a perspective view of a twelfth embodiment of a pneumatically adjustable bladder system of the invention for use in a cushioned seat bottom.
Figure 26:
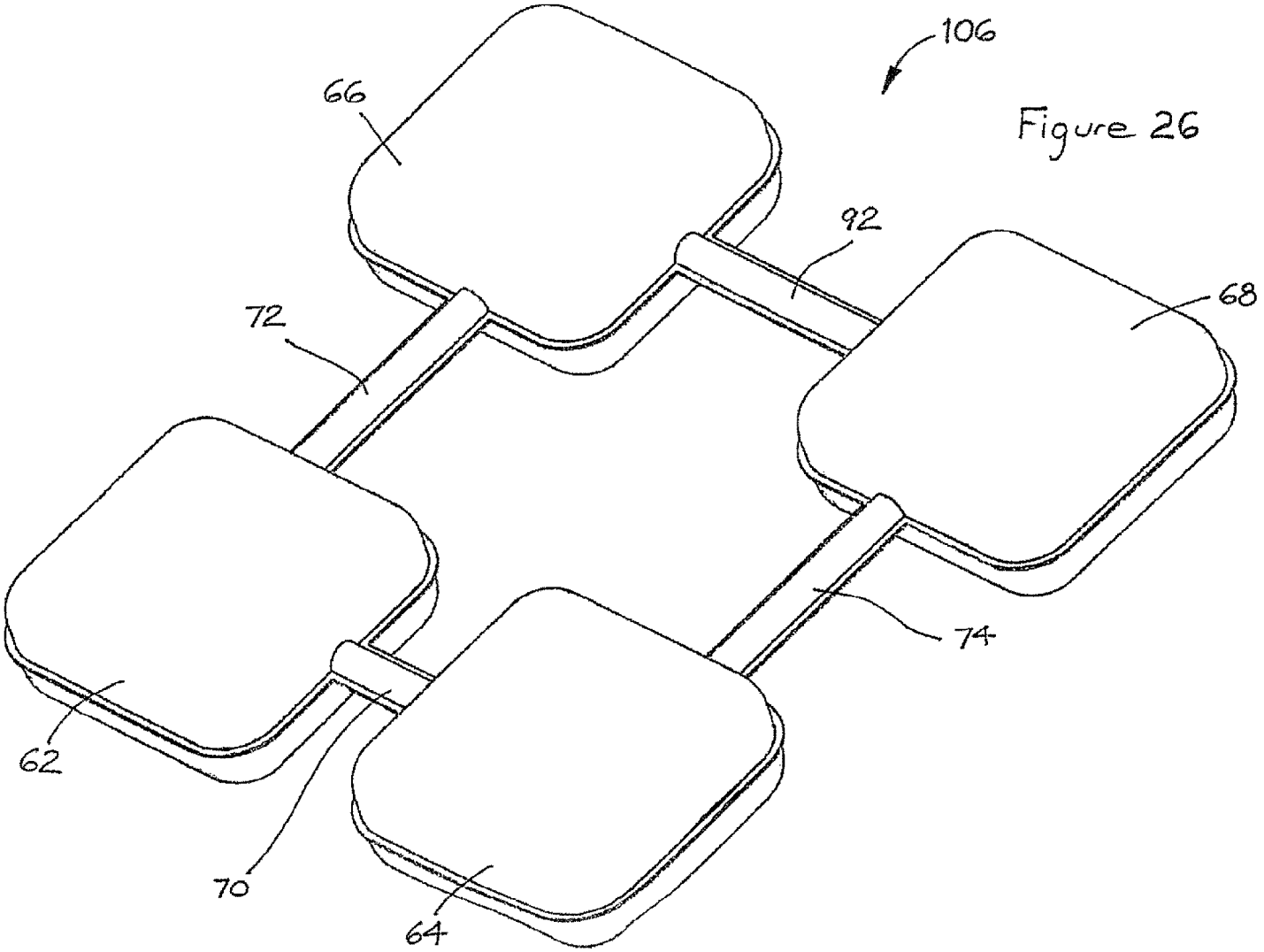
FIG. 26 is a perspective view of a thirteenth embodiment of a pneumatically adjustable bladder system of the invention for use in a cushioned seat bottom.

The bladder systems 100, 102, 104 shown in FIGS. 24, 25, 26, respectively, are identical in structure, function and operation to the bladder systems 60, 80, 90, respectively, except that the air inlet/outlet passageway 76 and the manually operable external air flow valve 78 have been omitted so that the seated occupant of the seat bottom cannot manually adjust the air pressure within any of the bladder systems 100, 102, 104. Like features are identified by like numerals.

The foam filled bladders used in the bladder systems 10, 30, 40, 50, 51, 53, 96 of the present invention are formed mainly according to the steps of the following high frequency welding process:

1. A first airtight sheet of flexible and weldable material, such as PVC film or TPU film, is laid on a base plate or lower platen of a high frequency welding machine that includes a suitably designed welding tool.
2. A suitable quantity of a compressible and expandable foam or foam-like material is accurately positioned onto the first sheet to a vertical thickness of about 50 mm.
3. A required number of lengths of 9 mm self-closing, semi-rigid, wrappable braided PET tubes or PVC tubes are accurately positioned onto the first sheet at locations which correspond to the desired positions of the air passageways, either of which serve to maintain optimal air flow through the air passageways.
4. A second airtight sheet of the flexible and weldable material used in step 1 is laid over the first sheet, the compressible material and the braided tubes.
5. An upper platen of the welding machine is lowered so that the welding tool forms a rigid weld joining the first and second sheets around their respective peripheries but also forms a 10 mm gap in the rigid weld, the rigid weld projecting horizontally outwardly (like a weld bead) from the so formed outer side walls of the foam filled bladder and so preventing substantial horizontal sideways stretching (either expansion or compression) of the outer side walls.
6. A spill is inserted into the 10 mm gap and the foam filled bladder is inflated with air until it is fully vertically expanded.
7. The 10 mm gap is sealed with a bar weld so as to form an airtight envelope around the compressible material, thereby sealing the foam filled bladder.

In order to form the foam filled bladders used in the bladder systems 60, 80, 90, 100, 102, 104, which are initially in a partially compressed/partially inflated state, the above process is carried out with suitable and well understood adjustments to form an interconnected arrangement of foam filled bladders only. In particular, there is an additional step of inserting a fully expanded but not yet sealed bladder system 60, 80, 90, 100, 102, 104 between the lower and upper platens of the welding machine and then lowering the upper platen to a predetermined position where the platens are a desired distance apart and a desired volume of air has been expelled by pressure of the platens from the interconnected foam filled bladders of the system. This creates the initial partially compressed/partially inflated state of the bladder systems 60, 80, 90, 100, 102, 104.

It will be readily apparent to persons skilled in the art that various modifications may be made in details of design and construction of the pneumatically adjustable bladder systems described above without departing from the scope or ambit of the present invention.

The invention claimed is:

1. A pneumatically adjustable bladder system for use in a cushioned seat bottom, the system comprising:

(a) a foam filled bladder adapted to be located under the ischial tuberosities of a seated occupant of the seat bottom, (b) one or more expansion chamber, the or each expansion chamber adapted to be located under the thighs of the seated occupant, and (c) one or more air passageways interconnecting the foam filled bladder with the or a respective expansion chamber, wherein the system is a closed air tight system with a fixed amount of air or other gas in the system and absent of means for adjusting the amount of air in the system by a user when in use, including by any external vent or valve;

wherein the foam filled bladder is compressible under the weight of the seated occupant and is expandable when the weight is removed, and wherein the compression of the foam filled bladder causes air from within the foam filled bladder to be displaced through the one or more air passageways to the or each expansion chamber which then expands, such that the compression of the foam filled bladder under the ischial tuberosities of the seated occupant and the expansion of the or each expansion chamber under the thighs of the seated occupant automatically cause the seated occupant's thighs to be raised and to experience a correct level of immersion into the cushioned seat bottom which is desired for effective postural support, pressure distribution and prevention of lower back pain without the user being required to make any adjustments to regulate the relative amounts of air in the bladders.

2. The bladder system of claim 1 wherein the foam filled bladder is compressible and expandable in a vertical direction but not substantially in a horizontal direction.

3. The bladder system of claim 1 wherein there are two expansion chambers and two air passageways, each air passageway interconnecting the foam filled bladder with a respective expansion chamber.

4. The bladder system of claim 1 wherein there is a single expansion chamber and two air passageways which interconnect the foam filled bladder with the single expansion chamber.

5. The bladder system of claim 1 wherein there are three expansion chambers and three air passageways, each air passageway interconnecting the foam filled bladder with a respective expansion chamber.

6. The bladder system of claim 1 wherein there is a single expansion chamber and a single air passageway which interconnects the foam filled bladder with the single expansion chamber.

7. A pneumatically adjustable bladder system for use in a cushioned seat bottom, the system comprising:

(a) at least one rear foam filled bladder adapted to be located under the ischial tuberosities of a seated occupant of the seat bottom, (b) a pair of front foam filled bladders adapted to be located under the thighs of the seated occupant, and (c) a pair of air passageways interconnecting the or each rear foam filled bladder with a respective front foam filled bladder, wherein the system is a closed, air tight system with a fixed amount of air or other gas in the system and absent of means for adjusting the amount of air in the system by a user when in use, including by any external vent or valve;

wherein the or each rear foam filled bladder is compressible under the weight of the seated occupant is expandable when the weight is removed, and wherein the compression of the or each rear foam filled bladder causes air from within the or each rear foam filled bladder to be displaced through the air passageways to the front foam filled bladders which then expand, such that the compression of the or each rear front foam filled bladder under the ischial tuberosities of the seated occupant and the expansion of the front foam filled bladders under the thighs of the seated occupant automatically cause the seated occupant to experience a correct level of immersion into the cushioned seat bottom which is desired for effective postural support, pressure distribution and prevention of lower back pain without the user being required to make any adjustments to regulate the relative amounts of air in the bladders.

8. The bladder system of claim 7 wherein each foam filled bladder is compressible and expandable in a vertical direction but not substantially in a horizontal direction.

9. The bladder system of claim 7 wherein there are two rear foam filled bladders, two front foam filled bladders and three air passageways, the two rear foam filled bladders being interconnected by an air passageway, and each rear foam filled bladder being interconnected to a respective front foam filled bladder by a respective air passageway.

10. The bladder system of claim 7 wherein there is a single rear foam filled bladder, two front foam filled bladders, and two air passageways, each air passageway interconnecting the single rear foam filled bladder with a respective front foam filled bladder.

11. The bladder system of claim 10 wherein each foam filled bladder is compressible and expandable in a vertical direction but not substantially in a horizontal direction.

12. The bladder system of claim 7 wherein there are two rear foam filled bladders, two front foam filled bladders, and four air passageways, the two rear foam filled bladders being interconnected by an air passageway, each rear foam filled bladder being interconnected to a respective front foam filled bladder by a respective air passageway, and the two front foam filled bladders being interconnected by an air passageway.

13. The bladder system of claim 9 wherein each foam filled bladder is compressible and expandable in a vertical direction but not substantially in a horizontal direction.

14. A pneumatically adjustable seating cushion comprising the bladder system of claim 1 and a cushioned seat bottom within which the bladder system is located.

* * * * *